US006233511B1

(12) United States Patent
Berger et al.

(10) Patent No.: US 6,233,511 B1
(45) Date of Patent: May 15, 2001

(54) ELECTRONIC CONTROL FOR A TWO-AXIS WORK IMPLEMENT

(75) Inventors: Alan D. Berger, Winfield; Peter J. Dix, Naperville, both of IL (US); Danley C. Chan, West Burlington, IA (US); James M. Grupka, Orland Hills, IL (US)

(73) Assignee: Case Corporation, Racine, WI (US)

( * ) Notice: Subject to any disclaimer, the term of this patent is extended or adjusted under 35 U.S.C. 154(b) by 0 days.

(21) Appl. No.: 09/196,675

(22) Filed: Nov. 20, 1998

Related U.S. Application Data

(63) Continuation-in-part of application No. 08/978,669, filed on Nov. 26, 1997, now Pat. No. 6,115,660.

(51) Int. Cl.[7] ..... E02F 3/43; B25J 9/16

(52) U.S. Cl. ..... 701/50; 414/699

(58) Field of Search ..... 701/50; 414/710, 414/697, 699; 172/2, 4; 37/907

(56) References Cited

U.S. PATENT DOCUMENTS

| | | |
|---|---|---|
| 3,726,428 | 4/1973 | Lark et al. . |
| 3,924,766 | 12/1975 | Canning . |
| 4,006,481 | 2/1977 | Young et al. . |
| 4,129,224 | 12/1978 | Teach . |
| 4,231,700 | 11/1980 | Studebaker . |
| 4,288,196 | 9/1981 | Sutton, II . |
| 4,332,517 | 6/1982 | Igarashi et al. . |
| 4,537,029 | 8/1985 | Gunda et al. . |
| 4,712,376 | 12/1987 | Hadank et al. . |
| 4,744,218 | 5/1988 | Edwards et al. . |
| 4,757,454 | 7/1988 | Hisatake et al. . |
| 4,831,539 | 5/1989 | Hagenbuch . |
| 4,839,835 | 6/1989 | Hagenbuch . |
| 4,844,685 | 7/1989 | Sagaser . |
| 4,910,662 | 3/1990 | Heiser et al. . |
| 4,964,779 | 10/1990 | Sagaser . |
| 5,083,894 | 1/1992 | Ikari et al. . |
| 5,160,239 | 11/1992 | Allen et al. . |
| 5,182,908 | 2/1993 | Devier et al. . |
| 5,220,968 | 6/1993 | Weber . |
| 5,305,681 | 4/1994 | Devier et al. . |

(List continued on next page.)

FOREIGN PATENT DOCUMENTS

| | | |
|---|---|---|
| 0 258 819 A1 | 3/1988 | (EP) . |
| 0 310 674 A1 | 4/1989 | (EP) . |
| 0 604 402 A1 | 6/1994 | (EP) . |
| 0 632 167 A2 | 1/1995 | (EP) . |
| 0 791 694 A1 | 8/1997 | (EP) . |
| 0 796 952 A1 | 9/1997 | (EP) . |
| WO 92/11418 | 7/1992 | (WO) . |
| WO 94/26988 | 11/1994 | (WO) . |

*Primary Examiner*—Michael J. Zanelli
(74) *Attorney, Agent, or Firm*—Foley & Lardner

(57) ABSTRACT

A loader of the type controlled with an electronic digital controller is disclosed herein. The loader may include conventional mechanical components. However, the hydraulic valve is electronically controlled to provide improved motion control. In particular, the operator controls the loader with a two-axis joystick. When the joystick is moved left or right, the bucket is rolled at a speed proportional to the rate of change of the joystick position and independent of the loader arms. When the joystick is moved forward or backwards, the loader arms of the bucket are raised or lowered. When the joystick is only moved forward or backward with substantially no component of motion left or right, the controller rolls the bucket to maintain a substantially constant angle between the bucket and the loader's frame. This constant attitude control decreases the operator workload and increases control accuracy. The controller provides velocity-based control over the loader arm and bucket motion, or flow-based control for improved stability and accuracy. The controller can monitor available flow and can then limit the commanded flows to the actuators to avoid exceeding the available flow.

35 Claims, 12 Drawing Sheets

U.S. PATENT DOCUMENTS

| | | | | |
|---|---|---|---|---|
| 5,327,347 | | 7/1994 | Hagenbuch . | |
| 5,347,448 | | 9/1994 | Nam . | |
| 5,356,260 | | 10/1994 | Ikari et al. . | |
| 5,383,390 | | 1/1995 | Lukich . | |
| 5,424,623 | | 6/1995 | Allen et al. . | |
| 5,434,785 | | 7/1995 | Myeong-hün et al. . | |
| 5,438,771 | | 8/1995 | Sahm et al. . | |
| 5,446,981 | | 9/1995 | Kamada et al. . | |
| 5,462,125 | | 10/1995 | Stratton et al. . | |
| 5,469,356 | | 11/1995 | Hawkins et al. . | |
| 5,469,646 | | 11/1995 | Takamura . | |
| 5,475,561 | | 12/1995 | Goeckner et al. . | |
| 5,501,570 | | 3/1996 | Mozingo . | |
| 5,516,249 | | 5/1996 | Brimhall . | |
| 5,527,156 | | 6/1996 | Song . | |
| 5,528,499 | | 6/1996 | Hagenbuch . | |
| 5,532,529 | | 7/1996 | Codina et al. . | |
| 5,535,532 | | 7/1996 | Fujii et al. . | |
| 5,535,587 | * | 7/1996 | Tanaka et al. | 60/427 |
| 5,537,818 | | 7/1996 | Hosseini et al. . | |
| 5,617,723 | | 4/1997 | Hosseini et al. . | |
| 5,620,053 | | 4/1997 | Kamikawa et al. . | |
| 5,629,849 | | 5/1997 | Ahn . | |
| 5,731,987 | | 3/1998 | Strong et al. . | |
| 5,737,993 | * | 4/1998 | Cobo et al. | 91/361 |
| 5,768,811 | | 6/1998 | Cooper . | |
| 5,875,701 | * | 3/1999 | Cobo et al. | 91/361 |

* cited by examiner

ELECTRONIC CONTROL FOR A TWO-AXIS WORK IMPLEMENT

CROSS REFERENCE TO RELATED APPLICATIONS

This application is a continuation-in-part of application Ser. No. 08/978,669, entitled ELECTRONIC COORDINATED CONTROL FOR A TWO-AXIS WORK IMPLEMENT, filed Nov. 26, 1997 now U.S. Pat. No. 6,115,660.

FIELD OF THE INVENTION

The present invention relates to controlling the motion of an implement which is moveable about at least two axes. In particular, the present invention relates to an electronic control which permits an operator to coordinate the motion of two axes of a work implement such as the arm and bucket motions of a loader. Both a velocity-based control approach and a flow-based control approach may be used, and the system can limit the fluid flow to the arm and bucket actuators based upon the availability of hydraulic fluid flow monitored using engine speed.

BACKGROUND OF THE INVENTION

A known implement having at least two axes and which is operated by providing control about the axes is a loader/bucket arrangement of the type used on tractors, skid-steer vehicles, articulated vehicles, backhoes, and tracked vehicles. Such an arrangement typically includes two loader arms pivotally attached to the vehicle at one end of the arms, and a bucket pivotally attached to the distal end of the arms. The loader arms are typically pivoted relative to the vehicle by hydraulic cylinders appropriately attached thereto to raise and lower the bucket. The bucket is pivoted relative to the arms by hydraulic cylinders appropriately attached thereto.

The power to actuate the hydraulic cylinders which produce the pivoting motion of the loader arms and of the bucket about their respective pivot axes is provided by pressurized hydraulic fluid supplied to the hydraulic cylinders by an appropriate pump or pumps driven by the vehicle engine, with the amount of available flow depending on engine speed. The flow of hydraulic fluid is controlled by valves which may be operated manually, electrically, or electromechanically. The valves for controlling the flow may also be pilot-operated hydraulic valves.

For many uses of loaders, it is desirable to maintain the orientation of the bucket relative to the surface upon which the associated vehicle is operating, or relative to the frame of the vehicle, as the loader arms are being raised or lowered. To achieve this result in certain conventional systems, the operator must manually control the valve for the hydraulic cylinders of the loader arms (i.e., "Arm Valve") while simultaneously controlling the valve for the hydraulic cylinder of the bucket (i.e., "Bucket Valve"). This simultaneous manual control over the Arm and Bucket Valves requires that the operator maintain visual contact with the bucket, which on certain vehicles is difficult. In many situations, the vehicle and loader configuration do not permit the operator to properly determine the orientation of the bucket over the full range of motion of the arm and bucket. In addition, manual control over both the Arm and Bucket Valves to maintain the bucket orientation relative to the surface, or the frame, increases the workload on the operator, resulting in increased operator fatigue and decreased operator capacity to control other vehicle and loader functions such as driving the vehicle. Further, manual control over both the Arm and Bucket Valves is subject to errors associated with any manual control operation, resulting in decreased control accuracy. For example, errors which result from manual control of both the Arm and Bucket Valves can result in rolling the bucket too much as the arms are raised and lowered, resulting in spillage of the load.

In response to this need for a loader arrangement which can maintain the orientation of the bucket relative to the surface over which the arm is raised and lowered, or relative to the vehicle frame, loaders have been designed to include self-leveling linkages which maintain the orientation of the bucket relative to the surface or to the vehicle frame. Alternatively, some loaders have been designed to combine the operation of the Arm and Bucket Valves to provide improved bucket orientation control. One problem with many of the presently used arrangements for bucket orientation control is the complexity of such arrangements. This complexity increases cost and in most cases, reduces reliability. Another problem with certain existing systems is the utilization of operator controls which are not easily and efficiently manipulated by the operator to achieve desired loader operations. Another existing system includes hydraulic leveling valves inserted between the Arm and Bucket Valves and the cylinders. As the arm is commanded to raise and lower, these leveling valves automatically roll the bucket to maintain the bucket level. However, these leveling valves are expensive, and have a relatively poor performance since the bucket is often allowed to drift from its level orientation.

In view of the need for improved bucket control and the drawbacks of existing systems, it would be desirable to provide an improved electronic system usable by an operator to effectively control the orientation of the arms and bucket of a loader or other implement requiring coordinated control about at least two axes. Such an automatic attitude control system for controlling bucket orientation would reduce operator workload, decrease operator fatigue, and increase control accuracy. Such a system can also be used for controlling anti-rollback and return-to-position.

In electrohydraulic systems, the amount of fluid flow from the engine-driven hydraulic pump effects how much the hydraulic valves need to be opened or closed to obtain a desired angular velocity of the loader arms and bucket. At times, there is not enough flow from the engine to achieve the desired velocity. Although it is possible to increase the power of the engine and pump to increase the available flow, such increases are expensive. Further, the operator of such vehicles may, at times, set the engine throttle low to reduce fuel consumption and/or noise, which will also result in a decrease in the available flow. In situations where the desired amount of fluid flow of multiple hydraulic actuators exceeds the available amount of fluid flow, some or all of the hydraulic actuators may become starved, resulting in improper and unexpected controller operations.

Further, even in cases where there is sufficient available fluid flow, and even though the closed-loop control of existing systems can adapt to changing flow levels, there will be some conditions (e.g., high engine speed with full throttle) where the valves will not be required to be open as much as normally, and there will be other conditions (e.g., low engine speed with low throttle) where the valves will need to be open further than normal. In existing systems, the controller cannot determine which situation the flow is in using only the information from the position sensors for the arm and the bucket. Thus, prior art controllers require high gain to allow the controller to make large corrections to account for changes in the amount of flow. With such high gain systems, however, problems with stability arise which cause, for example, oscillation. Therefore, there is a need for an improved arm and bucket controller that measures the engine speed and determines the available flow based at least partly on engine speed, such that the controller can use a smaller gain, thereby increasing the stability of the system and providing more accurate control.

Prior bucket control systems use velocity-based control, where the controller attempts to control angular velocity of the loader arms and bucket based upon a velocity command depending upon the position of a command device. In such velocity-based controls, however, there may be either too much error (e.g., the bucket may fail to reach a level orientation after being moved, such that position accuracy is poor), or the bucket orientation is not stable (e.g., the bucket position may oscillate, even though the position accuracy may be better). Thus, in prior bucket control systems, it is difficult to achieve the desired system accuracy and stability requirements due to the trade-off which must be made between the control accuracy and control stability, depending upon whether the gain is higher or lower.

Thus, it would also be desirable to provide a flow-based control that increases stability (i.e., eliminates oscillation) while reducing error (i.e., increasing position control accuracy) under all operating conditions of the system. It would also be desirable to have a flow-based control capable of determining the available flow, and limiting the commanded flows to avoid exceeding the available flow.

SUMMARY OF THE INVENTION

The present invention provides a motion control for an implement, such as, a loader used with a vehicle (e.g., a construction or agricultural vehicle). In the case of a loader, the control includes a first position sensor which generates a signal representative of the position of the loader arms relative to the vehicle, and a second position sensor which generates a signal representative of the position of the attachment (e.g., bucket, pallet forks, cold planer, hammer, bale spike, etc.) relative to the arms. The control also includes an input device (e.g., a joystick), to provide an operator interface which permits the operator to simultaneously or independently cause the control to pivot the arms relative to the vehicle or to pivot the attachment relative to the arms. The input device has a first signal generator for generating a first control signal representative of device motion about a first axis and a second signal generator for generating a second control signal representative of device motion about a second axis. A hydraulic valve assembly is responsive to electric valve signals provided to control hydraulic fluid flow to hydraulic actuators (e.g., cylinders) which pivot the arms and the attachment.

The intelligence for the motion control is provided by a digital control circuit coupled to the position sensors, the input device, and the hydraulic valve assembly. The control circuit applies the valve signals to the valve assembly such that hydraulic fluid flow is applied to the hydraulic actuators to pivot the arm so that the associated position signal and the associated control signal from the input device maintain a first predetermined relationship, and to pivot the attachment so that the associated position signal and the associated control signal maintain a second predetermined relationship. When the input device is manipulated by the operator such that a control signal is generated only as a result of motion about the first axis, the control circuit generates the valve signal which controls the hydraulic actuator for the attachment independent of the second control signal generated by the input device. More specifically, the attachment is pivoted to maintain a third predetermined relationship between the attachment and the frame of the vehicle, while the arms are pivoted by their associated hydraulic actuators.

The present invention also relates to a vehicle which includes the loader arrangement and motion control described above. For example, such a vehicle may be a tractor, a tracked vehicle including wheels which guide the tracks and support the vehicle, a skid steer vehicle, or an articulated vehicle. Depending on the characteristics of the hydraulic and mechanical systems (with the attachment), and the desired performance of the system, the first and second predetermined relationships may be based upon proportional control, integral control, derivative control, or a combination of these and other control schemes. The third relationship is typically to maintain a predetermined angle between the attachment and the frame of the vehicle. For example, when the attachment is a pair of lifting forks, the angle can be set to lift pallets or other objects at a constant angle (e.g., 0 degrees) with respect to the vehicle's frame. Where the attachment is a bucket, the predetermined relationship may take the form of an angle that changes as the arms are raised (e.g., rolling the bucket in to improve bucket filling when loading from a material pile).

The present invention further relates to a control for an implement with at least one arm pivotally supported by a vehicle and an attachment pivotally attached to the arm. The arm is pivoted relative to the vehicle, and the attachment is pivoted relative to the arm, by first and second hydraulic actuators. The vehicle includes a hydraulic fluid supply powered by an engine. The control includes first and second sensors for generating first and second signals representing the actual fluid flow being applied to the first and second actuators, respectively, and an input device including an interface assembly moveable by an operator relative to first and second axes, and first and second signal generators for generating first and second control signals representative of motion of the interface assembly about the first and second axis, respectively. The control also includes a valve assembly coupled to the fluid supply and responsive to first and second valve signals to control fluid flow to the first and second actuators, respectively. A digital control circuit determines the first and second actual fluid flows applied to the actuators based upon the sensed signals, determines first and second desired fluid flows based upon the first and second control signals, generates the first valve signal as a function of the first actual fluid flow and the first desired fluid flow, generates the second valve signal as a function of the second actual fluid flow and the second desired fluid flow, and applies the valve signals to the valve assembly to pivot the arm and attachment.

The present invention further relates to a control for such an implement. The control includes first and second sensors for generating sensed signals responsive to motion of the arm relative to the vehicle and motion of the attachment relative to the arm, a speed sensor coupled to the engine for generating an engine speed signal, an input device including an operator interface assembly moveable by an operator relative to first and second axes, and first and second signal generators for generating first and second control signals representative of motion of the interface assembly about the first and second axis, respectively. The control also includes a hydraulic valve assembly coupled to the fluid supply and responsive to first and second valve signals to control fluid flow to the first and second actuators. A control circuit applies the first and second valve signals to the valve assembly so that fluid flow is applied to the first actuator to pivot the arm so that the first sensed signal and first control signal maintain a first predetermined relationship, and fluid flow is applied to the second actuator to pivot the attachment so that the second sensed signal and second control signal maintain a second predetermined relationship. The control circuit also determines first and second desired fluid flows based on the first and second control signals, determines available hydraulic fluid flow based at least upon the engine speed signal, sums the first and second desired fluid flows, compares the sum to the available fluid flow, and limits the desired flows when the sum exceeds the available fluid flow.

BRIEF DESCRIPTION OF THE DRAWINGS

The invention will hereafter be described with reference to the accompanying drawings, wherein like numerals denote like elements and.

DETAILED DESCRIPTION OF THE PREFERRED EMBODIMENT

Figure 1:
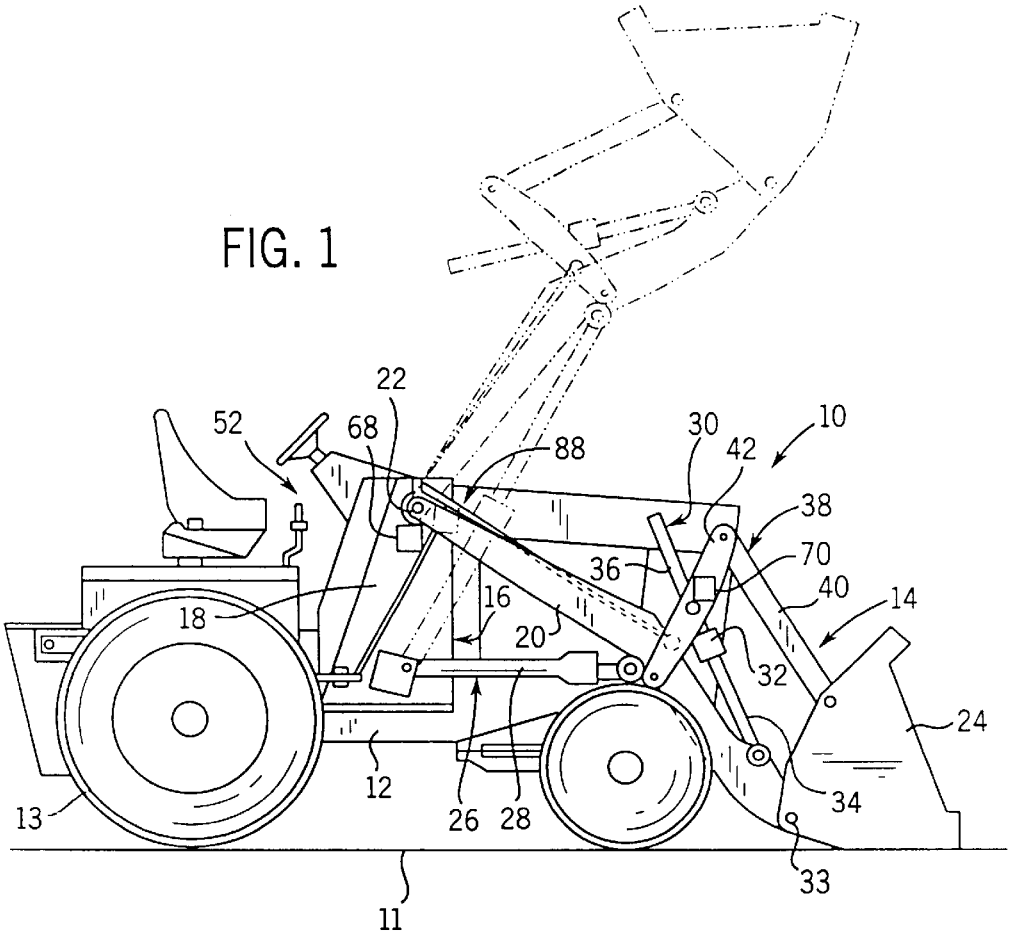
FIG. 1 is a side elevational view of an off-road work vehicle, including a loader mechanism.

With reference to FIG. 1, a loader 10 for an off-road vehicle such as a tractor, bulldozer, skid steer, or articulated vehicle is shown. In one embodiment, loader 10 is preferably configured to be a two-axis implement supported by a mobile main frame 12 onto which is mounted a loader mechanism 14. Mobile main frame 12 is movably supported by wheels 13 on a surface 11 that supports a bucket 24. Mobile main frame 12 further supports an engine (not shown) that ultimately drives wheels 13 to move on surface 11. The loader 10 may include a frame 16 that is attached to the vehicle permanently or removably. The frame 16 supports loader 10 and includes a pair of vertically upstruck supports 18 (only one is shown) arranged on opposite lateral sides of the implement frame 12.

Loader 10 further includes a pair of generally parallel loader arms 20. Each loader arm 20 is coupled by a pivot shaft 22 to an upper end of a respective support 18. A bucket 24 is pivotally coupled to and between the distal ends of loader arms 20.

Each loader arm 20 is angularly displaced relative to frame 12 and is pivoted about pivot shaft 22 via a suitable lift actuator 26 coupled between the respective loader arm 20 and support 18. A pair of extendable/retractable loader arm hydraulic cylinders 28 (only one is shown) is used to angularly position loader arms 20 and, thereby, bucket 24 relative to frame 12. Hydraulic pressure can be applied to either end of hydraulic cylinders 28. When hydraulic pressure is applied to the piston end, loader arm cylinders 28 are extended, and loader arms 20 are raised by pivoting about pivot shaft 22. Conversely, when pressure is applied to the rod end, the loader arm cylinders 28 retract, and loader arms 20 are pivoted in the opposite direction to lower bucket 24 attached to each distal end of loader arms 20.

Bucket 24 is pivoted or rolled between loading and unloading positions by a pivot assembly 14. Assembly 14 includes at least one tilt actuator 30. The tilt actuator 30 includes an extendable/retractable bucket hydraulic cylinder 32. Furthermore, a piston rod 34 of bucket cylinder 32 is articulately coupled to loader arms 20, while a cylinder portion 36 of bucket hydraulic cylinder 32 is coupled to bucket 24 through a bucket positioning linkage 38. Bucket positioning linkages 38 are generally the same for both loader arms 20 (only one is shown).

Bucket position linkage 38 includes a forward bucket link 40, one end of which is pivotally secured to bucket 24, and the opposite end of which is pivotally coupled to the end of a rear bucket link 42. The opposite end of the rear bucket link 42 is pivotally coupled to an intermediate portion of loader arm 20. As a result, pivotal movement of the rear bucket link 42 causes pivotal or rolling movements of bucket 24 relative to loader arms 20. To effect movement of the rear bucket link 42, the cylinder portion 36 of hydraulic bucket cylinder 32 is pivotally coupled to an intermediate portion of rear bucket link 42.

Application of hydraulic pressure to the piston end of bucket cylinder 32 causes bucket 24 to pivot or to roll rearwardly relative to lift arms 20, i.e., to roll back from the dump position to a carry or a level position. Conversely, application of hydraulic pressure to the rod end of bucket cylinder 32 causes bucket 24 to pivot or to roll forwardly. The two bucket positioning linkages 38 operate simultaneously to bring about the desired movement.

Figure 2:
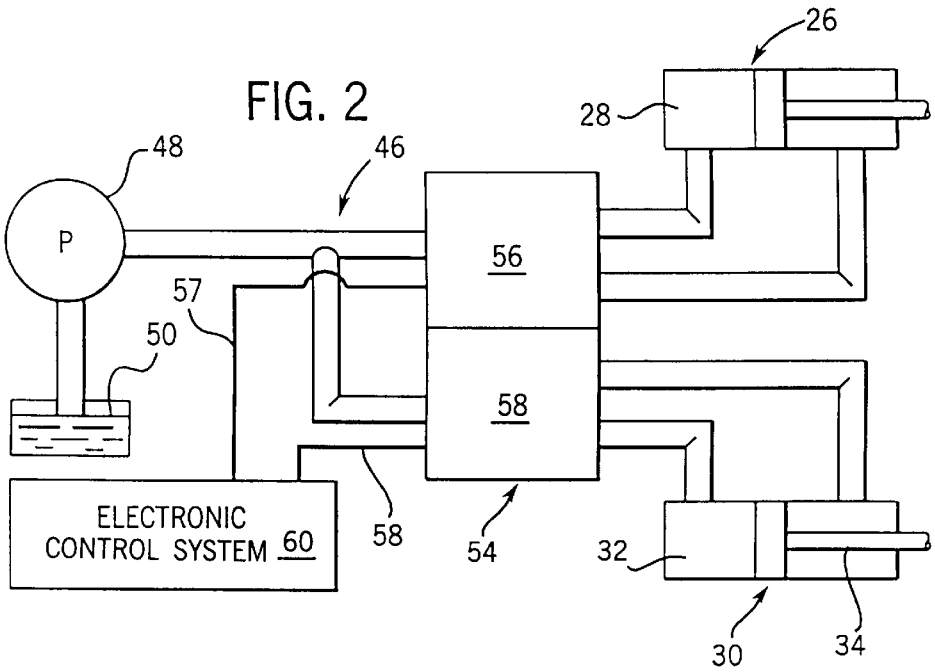
FIG. 2 is a schematic diagram of the hydraulic circuitry associated with the loader mechanism shown in FIG. 1.

With reference to FIG. 2, a hydraulic system 46 for operating loader 10 is coupled to loader arm cylinders 28 and bucket cylinder 32. System 46 further includes a pressurized hydraulic fluid source, such as, a pump 48, coupled to the engine which draws fluid from a sump 50 arranged on frame 12 (FIG. 1). Pump 48 is preferably a fixed displacement pump. Hydraulic fluid flow through hydraulic system 46 and to and from loader arm cylinders 28 and bucket cylinder 32 in a manner operating loader mechanism 14 is effected through an electronic control system 60 coupled to a solenoid-operated, hydraulic valve assembly 54 by signal conductors 57 and 58. Electronically controlled hydraulic valve assembly 54 further includes a loader arm lift valve 56 and a bucket tilt valve 58.

Hydraulic valve assembly 54 is connected to the pressurized fluid source 48 and is preferably mounted on frame 12. Loader arm lift valve 56 includes a valve stem (not shown) which linearly positions a spool valve (not shown), thereby regulating hydraulic fluid flow through valve 56 and controlling the "operative length" of loader arm cylinders 28. In particular, the operative length of loader arm cylinders 28 controls the angular disposition of loader arms 20 relative to frame 12. Similarly, tilt valve 58 also includes a valve stem (not shown) which linearly positions a spool valve (not shown), thereby regulating fluid flow through valve 58 and controlling the "operative length" of bucket cylinder 32. In particular, the operative length of bucket cylinder 32 controls the pivotal disposition of bucket 24 relative to loader arms 20. In the present embodiment, "operative length" refers to the effective distance between those locations on the respective cylinder or actuator which regulate the position of the particular mechanism coupled thereto. Valves 56 and 58 may alternatively include electrohydraulic valves wherein an electric actuator (e.g., a solenoid) positions the valve spool, or two-stage electrohydraulic valves having a first stage wherein an electrical actuator controls a pilot, and a second hydraulic stage wherein the pilot controls the main spool of the valve.

In general, loader 10 is a two-axis work implement, with each axis generally representative of an associated loader 10 motion. For instance, the first axis may represent primarily independent loader arm movement (e.g., rotation of arms 20 about shafts 22), with bucket 24 just following loader arms 20, and the second axis may represent mainly independent bucket movement (e.g. rotation about pins 33 attaching bucket 24 to arms 20). This motion is controlled by system 60.

In general, control system 60 is programmed to operate in both coordinated and uncoordinated modes. In the coordinated mode, the motion of both axes of the two-axis work implement are coordinated with each other. For example, control system 60 can automatically control bucket 24 (i.e., along the second axis) such that bucket 24 maintains the same orientation with respect to frame 12 as the operator commands loader arms 20 (i.e., along the first axis) to move. Bucket 24 and loader arms 20 can also be controlled to move in an uncoordinated fashion.

Figure 3:
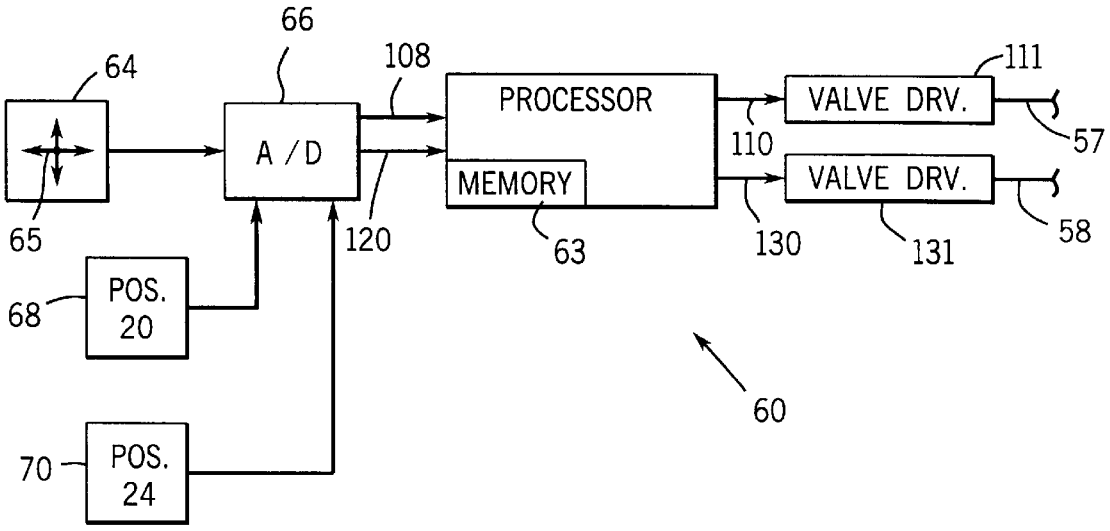
FIG. 3 is a schematic block diagram of an electronic control for the hydraulics of the loader mechanism.

Referring to FIG. 3, control system 60 is a digital control system including a digital processor 62 including memory 63, a valve driver circuit, and a microprocessor (e.g., Intel 80186, Motorola 68376) coupled to a signal input device such as a two-axis joystick 64, by an analog-to-digital converter 66. (Converter 66 may be separate from or integrated with either processor 62 or joystick 64.)

Joystick 64 includes a ever 65 moveable by an operator about two axes. Joystick 64 also includes a first signal generator for generating a first control signal representative of lever movement about the first axis and a second signal generator for generating a second control signal representative of lever movement about the second axis. More specifically, each signal generator is preferably a respective potentiometer that is coupled to the joystick lever, whereby a voltage change is generally representative of the magnitude and the direction (i.e., either a positive or a negative voltage change) of motion of the joystick lever about a corresponding axis. In the present embodiment, the first signal generator is a first potentiometer coupled to the lever to operate in response to motion of the joystick lever about the first axis. Similarly, the second signal generator is a second potentiometer coupled to the lever to operate in response to motion of the joystick lever about the second axis.

In one embodiment, the two axes are defined with reference to the direction of displacement of joystick lever 65 from the center position, e.g., a zero value. In particular, the first axis is preferably defined as either forward or backward displacement of the joystick lever from the center position (see FIG. 3), whereby positive values reflect forward motion, while negative values reflect backward motion. Similarly, the second axis is preferably defined as either right or left displacement of the joystick lever from the center position (see FIG. 3), whereby positive values reflect motion to the right, while negative values reflect motion to the left. Additionally, movement of the joystick lever about a particular axis correlates to movement of an associated function in loader system 10, i.e., first axis movement of the joystick lever generally correlates to movement of arms 20 (i.e. operation of cylinders 28), whereas second axis movement of the joystick lever generally corresponds to movement of bucket 24 (i.e. operation of cylinder 30).

Control system 60 also includes at least one loader arm position feedback sensor 68 (e.g. potentiometer which generates a voltage representative of angular position). Since both loader arms 20 generally move synchronously in the same direction, one position sensor provided on either loader arm 20 will typically be sufficient. Sensor 68 is preferably disposed at pivot shaft 22 of loader arm 20 via a linkage to measure the angle of arm 20 relative to frame 12. The linkage may provide a mechanical advantage which causes sensor 68 to generate a signal which is a function (e.g. proportional to) of the distance of cylinder extension. Sensor 68 is coupled to A/D 66 which generates a loader arm position signal 108 (an angular measurement of the orientation of loader arms 20 relative to frame 12) used by processor 62 in the control described in reference to FIGS. 4–6. Preprocessing of the raw position provided by sensor 68 may be needed to derive loader arm position signal 108, e.g., a correction based on the actual physical location of sensor 68 relative to pivot pin 22 of the loader arm onto which it is provided.

Control system 60 further includes at least one bucket position feedback sensor 70. Sensor 70 is preferably coupled between rear bucket link 42 and hydraulic cylinder 32 to generate a signal representative of the angle of bucket 24 relative to arms 20 about pins 33. Sensor 70 is coupled to A/D 66 which generates a bucket position signal 120 used by processor 62 in the control described in reference to FIGS. 4–6. Bucket position signal 120 is preferably an angular measurement of the orientation of bucket 24 relative to loader arms 20. Some processing of the signal generated by sensor 70 may be needed to derive bucket position signal at 120, e.g., a correction based on the actual physical location of the position sensor relative to the pivot point of the bucket and the specific geometry of pivot assembly 14.

By way of modification, sensors 68 and 70 may be of the type which generate signals representative of linear positions. Such sensors would be coupled to cylinders 26 and 32. By way of example, sensors 68 and 70 may include a micro-power impulse radar (MIR) generator, sensor and timing circuit of the type available from Lawrence Livermore Labs. In general, the MIR system is attached to cylinders 26 and 32 to measure cylinder piston position. Furthermore, the timing circuit may be configured to generate a piston position signal wherein A/D 66 is not required for converting the signals from sensors 68 and 70. With an arrangement using an MIR system, the rotational orientation of arms 20, bucket 24 and frame 12 relative to each other, can be calculated based upon the geometry of the components of loader 10.

Based upon the signals generated by joystick 64 and sensors 68 and 70, control system 60 generates appropriate valve command signals that are sent to the solenoids of hydraulic valve assembly 54 to open and close the valve orifices. The valve command signals generated by the digital control circuit are configured to be pulse-width-modulated (PWM) signals when the hydraulic valve assembly 54 is configured to include PWM valves (i.e., when loader arm valve 56 and bucket valve 58 are PWM valves). Alternatively, when PWM valves with integrated electronics are used, such as those available from Danfoss, the valve command signals may take the form of voltage signals. In response to the particular valve command signal received, hydraulic valve assembly 54 then directs hydraulic fluid flow to loader arm hydraulic cylinder 28 and/or to bucket hydraulic cylinder 32 to effect the pivoting of loader arms 20 or bucket 24, alone or in combination.

Figure 4:
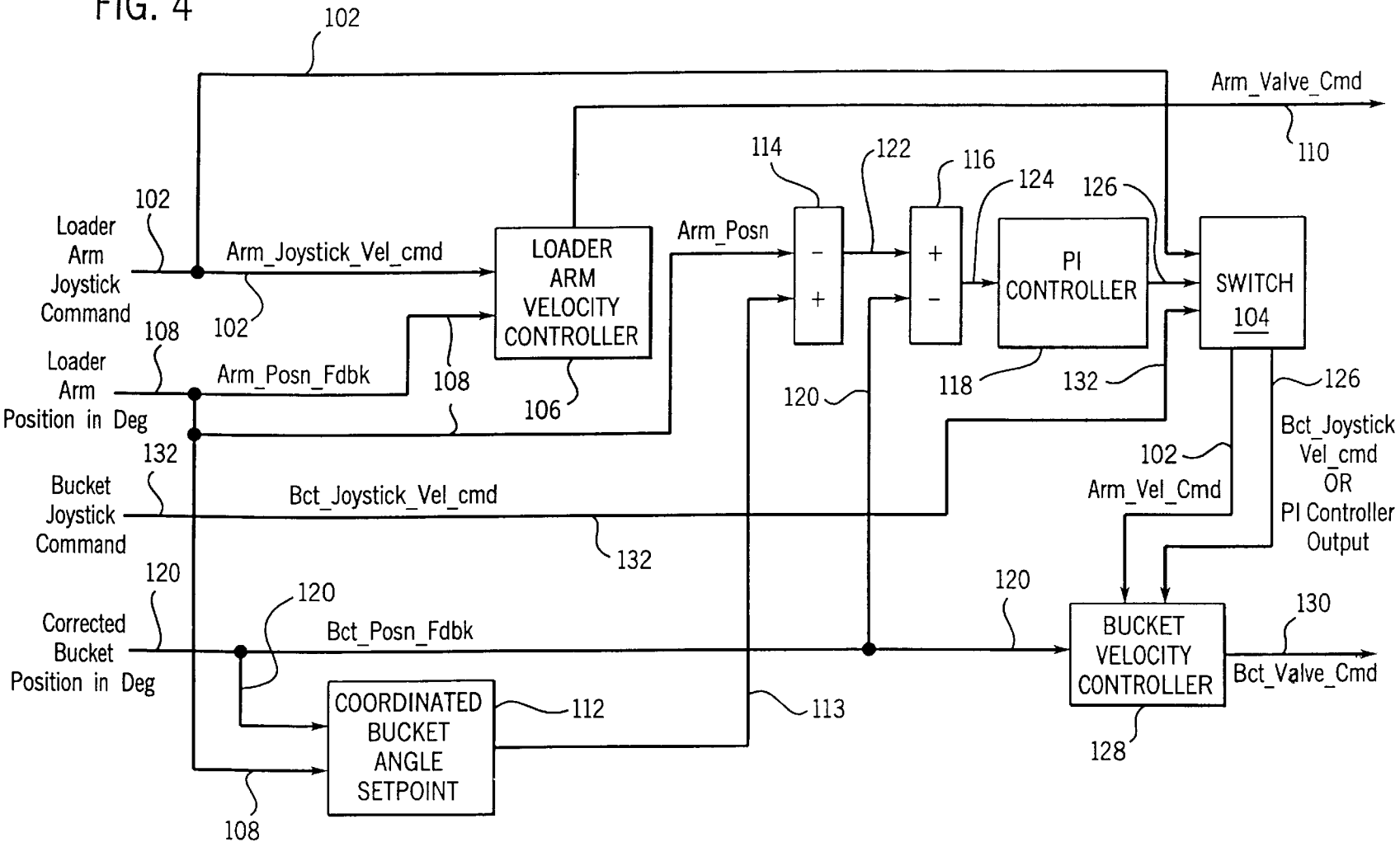
FIG. 4 is a schematic block diagram of the coordinated control circuit of the electronic control which provides velocity-based control of the loader mechanism of FIG. 1 by regulating the hydraulic circuitry shown in FIG. 2.

With reference to FIG. 4, processor 62 is programmed to provide the control system 60 as shown. Control system 60 advantageously utilizes the components described above to operate loader system 10 in various functional modes. In one embodiment, control system 60 provides three modes of operation: independent loader arm control, coordinated control and independent bucket control. Control system 60 can also provide a fourth mode of operation, uncoordinated arm and bucket control, where the arm and bucket are both moved but are independent.

Independent loader arm control mode is active when there is movement of the joystick lever about the first axis, with substantially no lever movement about the second axis, to generate the first control signal, i.e., the loader arm velocity signal at input 102. Signal 102 is applied to a switch box 104 and a loader arm velocity controller 106. (Controller 106 is described in detail below in reference to FIG. 5.) Loader arm velocity controller 106 also receives signal 108 generated from loader arm position sensor 68. Signal 108 provides the angular position of loader arms 20 relative to frame 12.

Loader arm velocity controller 106 integrates signals 102 and 108. More specifically, loader arm velocity controller 106 integrates the signals to preferably maintain a substantially proportional predetermined relationship between loader arm position signal 108 and loader arm velocity signal 102. Based upon signals 102 and 108, controller 106 then generates a loader arm valve signal 110.

Arm valve signal 110 is preferably configured to be a PWM signal applied to valve driver 111 (see FIG. 3) which provides amplification, conditioning and isolation to the signal to properly operate the electric solenoid for valve 56. In response, valve 56 directs hydraulic fluid flow to corresponding hydraulic cylinders 28, which are associated with loader arms 20. Hydraulic cylinders 28 then move the loader arms 20 to pivot as needed to maintain the predetermined relationship between loader arm position signal 108 and loader arm velocity signal at input 102. Further, hydraulic cylinders 28 also pivot loader arms 20 to maintain the rate of change of loader arm position signal 108 substantially proportional and integral with the rate of change of loader arm joystick signal 102. Ultimately, loader arms 20 pivot from their current position to the desired position required by the operator, as indicated by the degree of motion of lever 65 about the first axis.

Operator control of bucket 24 typically includes movement of joystick 64 about both the first and the second axes. Depending upon the motion of the joystick lever 65, control of bucket 24 will be in the independent bucket control mode or the coordinated control mode. Independent bucket control mode is active when there is lever 65 movement about the second axis, with substantially no lever 65 movement about the first axis. In contrast, coordinated control mode is active when there is lever 65 movement about the first axis, with substantially no lever 65 movement about the second axis. As discussed below, in coordinated control mode, control system 60 operates to maintain the orientation of bucket 24 with respect to frame 12 substantially constant when lever 65 is moved only about the first axis.

Since loader arms 20 are the sole support for pivot assembly 14 and bucket 24, any first axis movement of loader arms 20 also involves movement of bucket 24, even with no joystick lever 65 movement about the second axis. For example, to prevent accidental spillage of contents between loading and unloading operations, it is desirable to maintain bucket 24 in a generally leveled position relative to frame 12 (e.g., level) as loader arms 20 are either raised or lowered. The coordinated control mode and independent loader arm control mode preferably work together to coordinate bucket movement with loader arm movement such that bucket 24 maintains a predetermined orientation relative to frame 12. More specifically, a substantially constant angle is preferably maintained between bucket 24 and frame 12 while arms 20 are raised or lowered in response to movement of lever 65 about the first axis, with substantially no movement about the second axis.

The coordinated control mode can also maintain bucket 24 within a predetermined orientation (e.g., level) relative to surface 11 supporting vehicle 10. Assuming the orientation of frame 12 is fixed relative to surface 11, the coordinated control mode as described above will maintain bucket 24 within the predetermined orientation relative to both frame 12 and surface 11. However, the orientation of frame 12 can change with respect to surface 11 (e.g., due to the compression on wheels 13). In order to maintain the predetermined orientation of bucket 24 relative to surface 11 in this situation, the orientation of frame 12 relative to surface 11 may be sensed by appropriate sensors, and this sensed orientation may then be accounted for by the control based upon the geometry of loader 10 to maintain bucket 24 in the predetermined orientation with respect to surface 11.

Turning more specifically to the coordinated control mode, processor 62 of control system 60 is programmed to provide a coordinated bucket angle setpoint circuit 112, a first summer circuit 114, a second summer circuit 116, and a PI (proportional-integrator) control circuit 118. The feedback signal 108 generated from loader arm position sensor 60 is applied to circuits 106, 112 and 114. Circuit 112 further receives bucket feedback signal 120 from the bucket position sensor 70 to indicate the current position of bucket 24 relative to loader arms 20.

Circuit 112 preferably stores the sum of the values of signals 120 and 108. Since radial-coordinated motion seeks to hold the sum of the bucket angle and the loader arm angles constant, the values of signals 108 and 120 are converted to angle values ($\phi_{bucket}$ and $\phi_{arms}$) stored in memory 63.

Furthermore, a resultant angle constant ($\phi_{constant}$) is generated based upon the equation: $\phi_{constant}=\phi_{bucket}+\phi_{arms}$.

Coordinated bucket angle setpoint circuit 112 preferably calculates and stores $\phi_{constant}$ in memory 63 at the conclusion of any independent bucket operation. $\phi_{constant}$ may also be computed during every inactive phase of loader control. Therefore, $\phi_{bucket}$ and $\phi_{arms}$ for the above equation correspond to the bucket and arm angles at the conclusion of any independent bucket operation. Thus, circuit 112 stores $\phi_{constant}$ calculated at the end of each bucket operation.

$\phi_{constant}$ is applied to first summer circuit 114 at input 113. Circuit 114 further receives the angle value of signal 108 to indicate the current position of loader arms 20 relative to frame 12, i.e., $\phi_{arms}$. In circuit 114, $\phi_{arms}$ is preferably assigned a negative value, whereas $\phi_{constant}$ is preferably designated a positive value. As a result, circuit 114 subtracts the current loader arm position ($\phi_{arms}$) from the stored angle constant ($\phi_{constant}$) to derive a new bucket position ($\phi_{bucket}$). The new bucket position is applied to the input 122 of a second summing circuit 116.

Circuit 116 further receives the angle value of signal 120 from sensor 70 to provide the current position of bucket 24 relative to loader arms 20. Circuit 116 assigns a positive value to the new $\phi_{bucket}$, whereas the current angle value of signal 120 ($\phi_{bucket}$) is preferably designated a negative value. Circuit 116 then subtracts the previous value of $\phi_{bucket}$ from the current value of $\phi_{bucket}$ to create an error signal at output 124. More specifically, the error signal at output 124 is the angular difference between the desired bucket angle generated from circuit 114 and the current bucket angle generated by the bucket position sensor 70. This difference requires correction to maintain the constant angle $\phi_{constant}$ stored in memory 63.

The error signal on output 124 is provided to and manipulated by a proportional-integral (PI) controller 118. PI controller 118 subsequently generates a velocity signal at output 126 which is applied to a bucket velocity controller 128 via a switch box 104. In particular, the bucket velocity signal at output 126 generated by PI controller 118 is representative of the velocity that bucket 24 needs to acquire in order to force the error signal at output 124 to zero, and is proportional to the integral of the error signal (e.g. bucket velocity command=$\int$K×error) at output 124. The proportionality constant depends upon the size and configuration of loader 10. Moreover, PI controller 118 generally updates the needed bucket velocity signal on a continuous basis, i.e., PI controller 118 constantly adapts to new conditions. By way of example, processor 62 executes the program loop which provides the circuit functions shown in FIGS. 4–6 at an update rate of 10 msec. Thus, each of the functions is performed at a periodic rate of once per 10 msec. Other loop updates rates may also be used, subject to system stability requirements.

In addition to the velocity signal issued by PI controller 118, switch box 104 also receives loader arm joystick velocity signal on input 102. Hence, the loader arm velocity signal at input 102 and the PI controller velocity signal at input 126 are not altered by switch box 104. Switch box 104 selectively applies the PI controller velocity signal at input 126 and the loader arm velocity signal at input 102 to bucket velocity controller 128. (The switch box function will be further discussed with reference to independent bucket control mode.) Bucket velocity controller 128 subsequently integrates both signals and generates a bucket valve signal at output 130.

The bucket valve signal at output 130 is preferably configured to be a PWM signal which is applied to hydraulic valve assembly 54. The PWM signal is applied to a valve driver circuit 131 (see FIG. 3) which provides amplification, conditioning and isolation to the signal to properly operate the electric solenoid for valve 58. In response to the signal from driver 131, valve 58 controls hydraulic fluid flow to the corresponding hydraulic cylinder 32. Cylinder 32 then drives bucket 24 to follow loader arms 20 and to pivot to maintain the predetermined orientation with respect to frame 12. More specifically, cylinder 32 drives bucket 24 to synchronously move at the same velocity as loader arms 20 and to pivot such that a constant angle is maintained between bucket 24 and frame 12 during coordinated control mode of controller system 100. Thus bucket 24 can be positioned with the bottom thereof level relative to frame 12, and maintained level while loader arms 20 are raised or lowered between loading and unloading operations, to prevent accidental spills. This is accomplished without manual control of the bucket 24 position by the operator. As a result, operation efficiency is improved, whereas fatigue to the operator is reduced.

During unloading operations of bucket 24, the control of loader arms 20 is preferably configured such that loader arms 20 remain essentially stationary. During loading operations of bucket 24 by a skilled operator, the control is configured such that arms 20 and bucket 24 are both moved in an uncoordinated fashion. Thus, loading and unloading operations of bucket 24 generally occur when the independent bucket control mode of controller system 100 is active. More specifically, independent loader arm control mode and coordinated control mode are both typically inactive during operation of independent bucket control mode.

Independent bucket control mode is active when there is movement of joystick lever 65 about the second axis, with substantially no movement of lever 65 about the first axis, to generate a bucket velocity signal at input 132. The bucket velocity signal is representative of the desired bucket velocity. Thus, system 60 operates to rotate the bucket at a speed related to (e.g. proportional) the distance lever 65 is moved from its center position. The second control axis signal at input 132 is also applied to switch box 104. Switch box 104 gives active independent bucket control priority. More specifically, switch box 104 uses the bucket velocity axis control signal at input 132 as a basis to determine whether bucket 24 should follow loader arms 20 or should move independently. In particular, if the second control signal represents that lever 65 is at a non-zero position relative to the second axis, (i.e., independent bucket control mode is active) then bucket velocity signal at input 132 is applied directly to bucket velocity controller 128. However, if lever 65 is at its zero position (centered) relative to the second axis (i.e., independent bucket control mode is inactive), and coordinated control mode is active, the velocity signal at input 126 from PI controller 118 is applied to bucket velocity controller 128 from switch box 104. Under independent bucket control mode, switch box 104 is preferably configured to small set velocity signals at input 126 and small loader arm joystick velocity signals at input 102 to zero, thereby allowing only the axis bucket velocity signal at input 132 to be applied to bucket velocity controller 128.

As shown in FIG. 4, bucket velocity controller 128 further receives the bucket position signal at input 120 from bucket position sensor 70, thereby providing the current position of bucket 24 with respect to loader arms 20. In the independent bucket control mode, bucket velocity controller 128 integrates the signals at inputs 102 and 120. More specifically, bucket velocity controller 128 integrates both input signals such that a predetermined relationship (e.g. proportional) is maintained between the second axis control signal at input 132 and bucket position signal at input 120.

Bucket velocity controller 128 then generates the bucket valve signal at output 130 based upon the integral of the bucket velocity signal at output 132 and the bucket position signal at input 120. The bucket valve signal is a PWM signal applied to valve driver circuit 131 to control cylinder 32 as previously described in detail above. Accordingly, hydraulic cylinder 32 pivots bucket 24 to maintain the predetermined relationship between the bucket position signal at input 120 and the bucket velocity signal at output 132. Hydraulic cylinder 32 is also controlled so that the rate of change of bucket position signal at input 120 is substantially proportional to the rate of change of the bucket velocity signal at output 132. Thus, system 60 operates to tilt, pivot or rotate bucket 24 in accordance with the degree of motion of joystick lever 65 about the second axis.

In one embodiment, controller system 100 is configured to automatically switch between the coordinated control mode and uncoordinated arm and bucket control, where the arm and bucket are both moved but are independent. This switch could be accomplished with a manual switch the operator could control.

Figure 5:
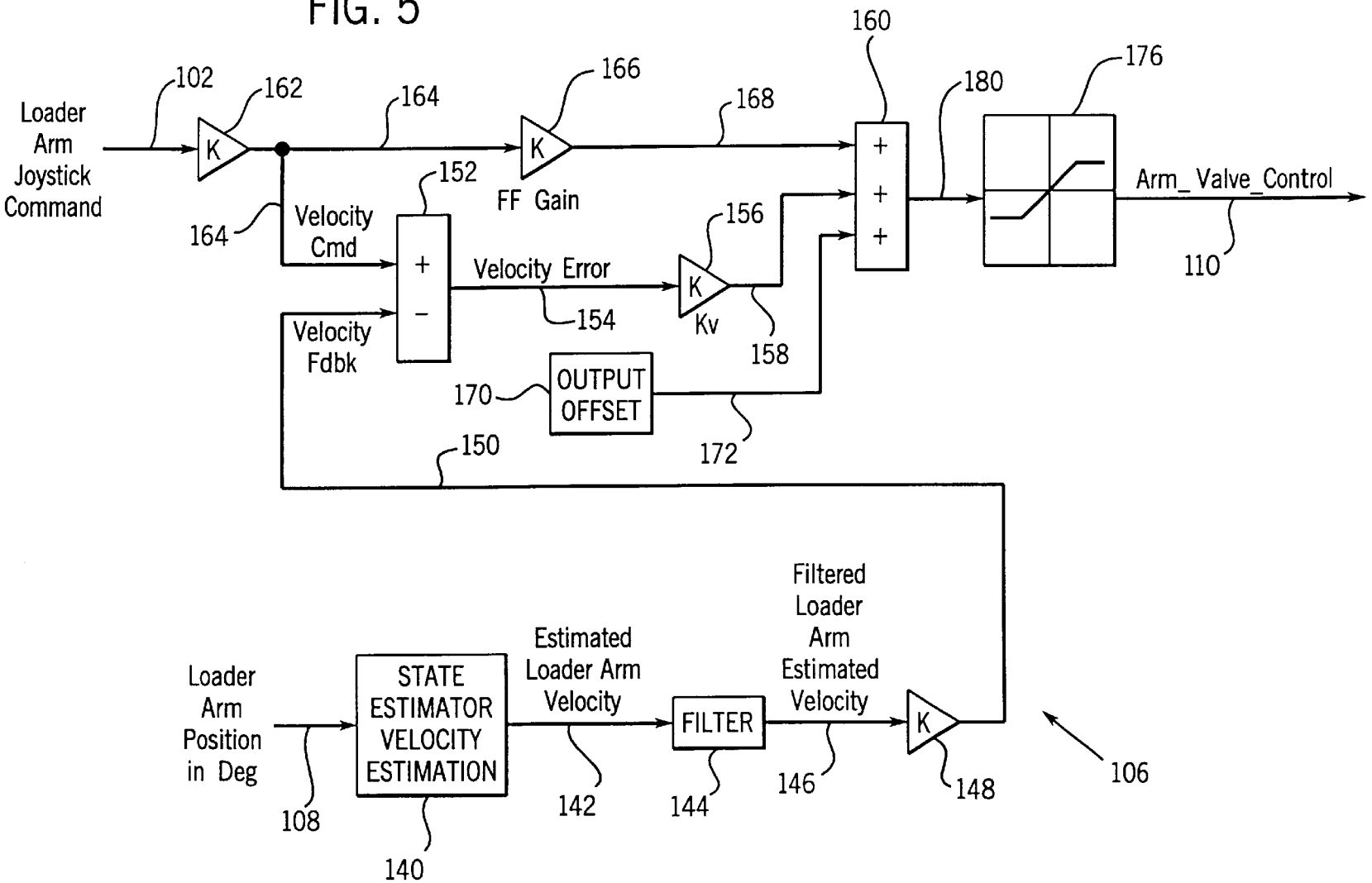
FIG. 5 is a block diagram of the loader arm velocity controller circuit of the electronic control illustrated in FIG. 4.

Referring to FIG. 5, loader arm velocity control 106 will be described in further detail. Control 106 uses the position signal at input 108 to estimate the current velocity of loader arms 20 with a velocity estimator 140 to generate an estimated loader arm velocity signal at output 142 from the loader position signal 108. Velocity estimator 140 is preferably configured to be a third order Lanczos-type filter. The Lanczos filter provides simultaneous velocity estimation and low pass filtering, which sharply reduces the noise as compared to a typical differentiator. Alternatively, if direct velocity feedback is available, such as, that produced by a tachometer, it can be used instead of the estimated velocity.

The velocity signal at output 142 is applied to a filter 144. Filter 144 is preferably a low pass filter that further removes high frequency noise, thereby preventing velocity controller 106 from reacting to false signals. Filter 144 subsequently generates a filtered estimated loader arm velocity signal at output 146. The signal at output 146 is then multiplied by a constant at amplifier 148 to produce a velocity feedback signal at output 150. Amplifier 148 typically uses a conversion factor that ensures unit compatibility between the current loader arm velocity estimated from position signal 108 and the loader arm velocity signal at input 102 generated as a result of joystick lever movement about the first axis. The signal at output 150 is applied to a summing circuit 152.

Loader arm velocity signal 102 is applied to an amplifier 162 which multiplies the signal by a constant which is a conversion factor used to scale the loader arm velocity signal, (e.g., degrees per second) to generate a scaled velocity signal at output 164. The signal at output 164 is applied to summing circuit 152, and a feed-forward gain amplifier 166.

Circuit 152 is configured such that the velocity signal at output 164 is preferably designated a positive value, whereas the velocity feedback signal at output 150 is generally assigned a negative value. As a result, circuit 152 subtracts the velocity feedback signal from the velocity signal 164 to derive a velocity error signal at output 154. The velocity error signal is then multiplied with a standard control factor gain by amplifier 156. The control gain 156 represents the degree to which controller 106 reacts to error signal at output 154, i.e., the difference between the desired loader arm velocity signal at 164 and the estimated loader arm velocity signal at 150. The signal at the velocity error signal at 154 is multiplied by another control gain by amplifier 156. The output of amplifier 156 is coupled to a summing circuit 160.

Circuit 160 is also coupled to output 168. Output 168 provides a nominal valve-opening setpoint for the particular loader arm velocity signal applied to input 102. Additionally, circuit 160 is coupled to an output offset signal at input 172 generated by an offset circuit 170. Output offset signal 172 forms a bias or null point signal about which output signal 180 swings, and is necessary to ensure closure of the particular valve used in the independent loader arm control mode. More specifically, output offset signal 172 is the nominal valve-closing voltage required to close a particular valve, e.g., loader arm valve 56. In one embodiment, output offset signal 172 is configured to be ½ of the vehicle's battery voltage (i.e., 6 V with a 12 V vehicle battery), and output signal 180 is configured to swing within a working range with a minimum of 3 V and maximum of 9 V. Alternative configurations of loader arm velocity controller 106 may not require an offset term.

The signals applied to inputs 158, 168 and 172 are assigned positive values. As a result, the inputs to circuit 160 are added to generate an arm valve signal at output 180. To more accurately generate an output signal representative of the valve signal needed in response to a loader arm velocity signal at 102 and loader arm position signal at 108, circuit 160 requires the input signal from output offset circuit 170. More specifically, the output offset signal at 172 shifts the valve signal that would otherwise be generated by the sum of input 168 and output 158 by the nominal voltage needed to drive loader arm valve 56 of valve assembly 54 to its closed position, e.g., 6 volts. For example, at circuit 160, the value of the sum of inputs 158 and 168 can come to be the equivalent of zero volts, intending to command the closure of loader arm valve 56. However, zero volts would not be sufficient to drive loader arm valve 56 to close. Therefore, output offset signal at 172 is added as a bias or null point input to circuit 160 to ensure that a more accurate signal at 110 is generated to effect the desired outcome.

The signal at output 180 is applied to a saturation or limiter circuit 176 arranged at the output of controller 106. Saturation circuit 176 maintains the output signal circuit 160 within maximum and minimum voltage limits of a work range within which velocity controller 106 operates the valves in valve assembly 54. In one embodiment, the maximum and minimum voltage output limits for the controller 106 work range are 9 V and 3 V, respectively. Circuit 176 generates the loader arm valve signal at output 110 which is applied to valve driver 111 which controls the solenoids of valve 56 to control hydraulic fluid flow to hydraulic cylinders 28 to effect movement or non-movement, respectively, of loader arms 20.

Figure 6:
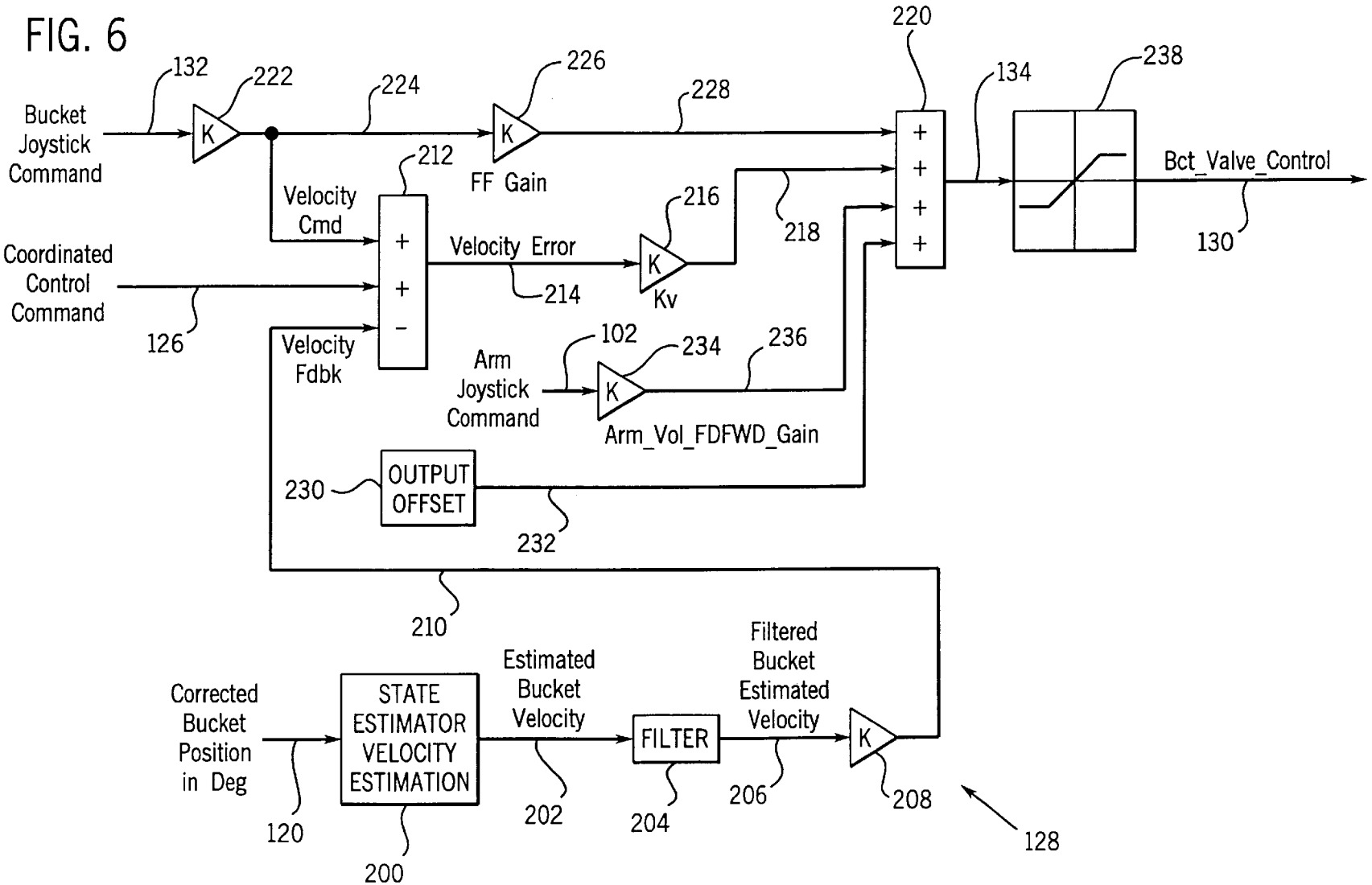
FIG. 6 is a block diagram of the bucket velocity controller circuit of the electronic control illustrated in FIG. 4.

Referring to FIG. 6, bucket velocity controller 128 is shown in further detail. The control logic used to operate bucket velocity controller 128 is substantially similar to the control logic used to operate loader arm velocity controller 106. The difference in the control operation of bucket velocity controller 128 depends upon the control mode under which system 60 is operating. As previously described with reference to FIG. 4, bucket velocity controller 128 operates during coordinated control mode and independent bucket control mode of control system 60.

As previously discussed, controller 128 receives three input signals: the velocity signal generated by PI control 118 at output 126, the loader arm velocity signal at input 102, and the bucket position signal at output 120. In particular, during coordinated control mode, bucket joystick velocity signal 132 is unused (i.e., inactive), while the loader arm velocity command at input 102 and velocity signal at output 126 are applied by switch circuit 104 to controller 128.

As previously discussed, the bucket position signal at input 120 is processed and geometrically corrected before it is sent to bucket velocity controller 128. Bucket velocity controller 128 then uses the corrected bucket position signal at input 120 to estimate the current velocity of bucket 24. More specifically, velocity controller 128 utilizes a velocity estimator 200 to generate an estimated bucket velocity signal at output 202 from the bucket position signal 120. The velocity estimator 200 is preferably configured to be a third order Lanczos-type filter, substantially similar to the velocity estimator 140 used in the loader arm velocity controller 106. Alternatively, if direct feedback is available, such as, that produced by a tachometer, it can be used instead of the estimated velocity.

The estimated bucket velocity signal at output 202 is applied to a filter 204. Filter 204 is preferably a low pass filter that further removes high frequency noise, thereby preventing velocity controller 128 from reacting to false signals. Filter 204 is substantially similar to filter 144 used in loader arm velocity controller 106. Filter 204 generates a filtered estimated bucket velocity signal at output 206. The filtered estimated bucket velocity at output 206 is then multiplied by a constant by amplifier 208. The constant is typically a conversion factor that ensures unit compatibility between the current bucket velocity estimated from position signal 120 and the PI controller velocity signal at output 126 generated as a result of joystick lever 65 movement about the first axis, with substantially no second axis lever movement. When the filtered estimated bucket velocity signal is amplified by amplifier 208, the result is an actual bucket velocity feedback signal at output 210. The signal at 210 is applied to a summing circuit 212.

The velocity signal at output 126 is also applied to circuit 212. Circuit 212 subtracts the velocity feedback signal at output 210 from the velocity signal at output 126 to derive a velocity error signal at output 214. Velocity error signal 214 is then multiplied by a standard control gain by amplifier 216. The control gain represents the responsiveness of controller 128 to error signal 214. The output 218 of amplifier 216 is applied to a summing circuit 220.

As previously described with reference to control system 60, the coordinated control mode preferably occurs when the independent loader arm control mode is active. As a result, bucket velocity controller 128 also receives the loader arm velocity signal at 102 as an input. Bucket velocity controller 128 multiplies velocity signal 102 by an arm velocity feed-forward gain via amplifier 234 to generate an amplified signal at output 236. The signal at output 236 provides a nominal valve-opening setpoint for the particular loader arm velocity signal at 102, and is applied to circuit 220.

Circuit 220 also receives an output offset signal at input 232 generated by an offset circuit 230. Circuit 230 is similar to the output circuit 170 used in loader arm velocity controller 106, and provides biasing necessary to ensure closure of the valve used during coordinated control mode to control cylinder 32. More specifically, the signal at output 232 is the nominal valve-closing voltage required to close a particular valve, e.g., the bucket valve 58. In one embodiment, the offset signal at 232 is configured to be 6 volts.

The inputs to circuit 220 are added to generate bucket command signal at output 134. To more accurately generate an output signal at 134 representative of the valve signal needed in response to the coordinated control command 126, at the loader arm velocity command at 102, and the bucket position signal at 120, circuit 220 uses the input signal from output offset circuit 230. More specifically, the output offset signal at 232 shifts the command signal that would otherwise be generated by the sum of output 218 and output 236 by the nominal voltage (e.g. 6 volts) needed to drive bucket valve 58 of valve assembly 54 to its closure position. For example, the value of the sum of output 218 and output 236 can be equal to zero volts, ideally commanding the closure of bucket valve 58. However, zero volts will not typically be sufficient to drive bucket valve 58 closed. Therefore, the output offset signal at 232 is an input to circuit 220 to ensure that a more effective command at 134 is generated to effect the desired outcome.

The command at 134 is applied to a saturation or a limiter circuit 238 arranged at the output of controller 128. Circuit 238 maintains the valve signals between maximum and minimum voltage output limits of a work range within which velocity controller 128 operates the valve solenoids in valve assembly 54. In one embodiment, the maximum and minimum voltage output limits for the controller 128 work range are preferably 9 volts and 3 volts, respectively. The signal from circuit 238 is applied to hydraulic valve assembly 54 via valve driver 131 (see FIG. 3) to control hydraulic fluid flow to hydraulic cylinder 32 which effects movement or non-movement of bucket 24.

Bucket velocity controller 128 also receives the bucket velocity signal at 132. During independent bucket control mode, the bucket velocity signal at 132 is nonzero (i.e., lever 65 is offset from its center position relative to the second axis).

The bucket velocity signal at output 132 is multiplied by a constant by amplifier 222 to similar to constant 208, i.e., it is a conversion factor used to scale the bucket velocity signal to correspond to a velocity in units of degrees per second. The velocity signal at output 224 is applied to summing circuit 212, and an amplifier 226 which multiplies the signal at 224 by a feed-forward gain constant. The constants ensure that the bucket velocity signal and actual bucket velocity feedback signal are applied to circuit 212 with the same units.

Circuit 212 subtracts the velocity feedback signal at 210 from the velocity signal at 224 to derive a velocity error signal at output 214. Velocity error signal 214 is then multiplied by standard control gain by amplifier 216 to generate a signal at output 218 applied to circuit 220.

Circuit 220 further receives the signal from input 228. Circuit 220 adds the signals from inputs 218, 228, 232 and 236 to generate a command signal at 134. Signal 134 is then processed as described in detail above to ultimately control the motion of bucket 24.

Thus, based upon the signals generated by joystick 64 and position feedback sensors 68 and 70, processor 62 is programmed according to the velocity-based control of FIGS. 4–6 to generate loader arm valve signal 110 and bucket valve signal 130 for application to loader arm lift valve 56 and bucket tilt valve 58. Although this velocity-based control advantageously provides control over motion of arms 20 and bucket 24 in up to four modes of operation (i.e., independent loader arm control, independent bucket control, coordinated control, uncoordinated arm and bucket control mode), conditions exist wherein the above-described control algorithms may not be optimal. In particular, as a velocity-based control, it may still be difficult to find the proper trade-off between control accuracy and stability in selecting system gain for the above-described control. Also, this control does not limit the commanded flows to avoid exceeding the available flow. These and other problems are solved by another embodiment of the invention, as described below.

Of course, features of the velocity-based control described above can be combined with the flow-based control described below in various combinations. For example, the feature of the flow-based control which includes sensing engine speed to determine available fluid and then limiting the commanded flows to avoid exceeding the available flow, described below, can be combined with the velocity-based control described above to limit the velocities of the cylinders to avoid exceeding the available flow, thereby achieving some advantages of the flow-based control. To incorporate this feature into the velocity-based control, engine speed would be measured and the velocity commands decreased ratiometrically based upon the engine speed to insure that the cylinders would not be starved of fluid flow. The relationship between the velocity-based commands and commanded flow could be determined empirically or via hydraulic modeling of the system. This relationship could be defined with a margin of error such that not all the flow would be provided to the cylinders under all conditions. The difficulty in determining the relationship that exists between the velocity-based commands and the actual flows illustrates one of the advantages of the below-described flow-based control. By controlling based directly upon flows, wherein even the joystick commands are interpreted as flows, there is a known relationship between the flow commands and the actual flow.

Figure 7A:
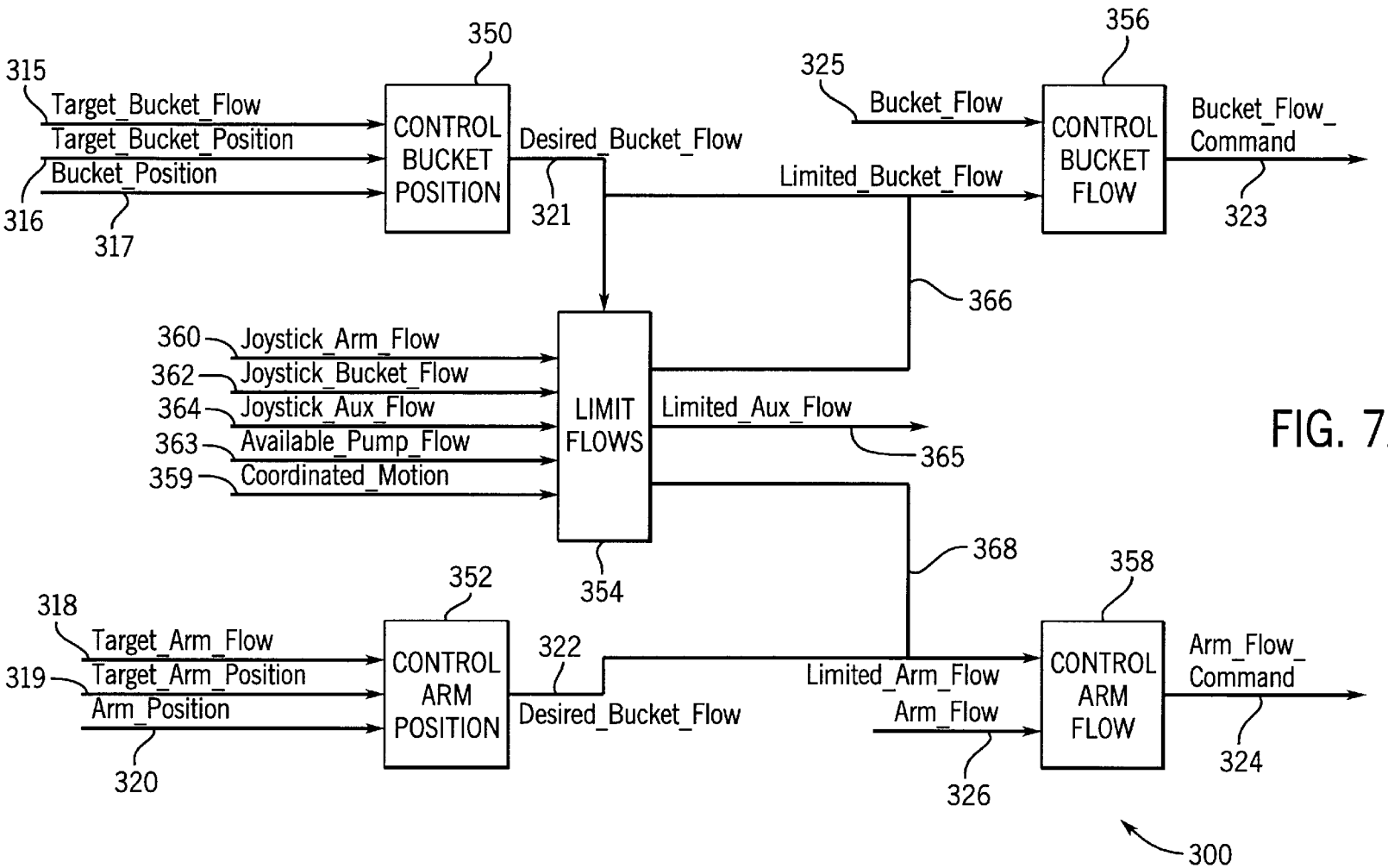
FIG. 7A is a schematic block diagram of the coordinated control circuit of the electronic control which controls the loader mechanism of FIG. 1 by regulating the hydraulic circuitry illustrated in FIG. 2 according to an alternate embodiment of the present invention incorporating flow-based control, and capable of limiting the commanded amount of fluid flow to the available amount.

Referring to FIGS. 7A–14, another embodiment of the invention incorporates a flow-based control approach wherein processor 62 is programmed to provide a control circuit 300 which interprets the input signals from joystick 64 as hydraulic fluid flow commands, and manages the control signals applied to cylinders 28 and 32 after considering available pump flow estimated from engine speed. FIG. 7A shows the feedback control loops used to generate the arm and bucket flow commands in a closed-loop based upon commanded and feedback flow values. Thus, this embodiment uses a flow-based approach to control the movement of arms 20 and of bucket 24. This approach provides increased stability and accuracy over systems which control the angular velocity of the arms or bucket based on joystick position since velocity-based control systems require a relatively high gain to make the large corrections required to account for changes in the flow through the valves which occur as operating conditions (e.g., throttle setting; bucket loading) change. In addition, controlling based on flow allows the flow to be limited more accurately, and helps to insure that the cylinder for bucket 24 will always receive an adequate flow to maintain coordinated control while operating in coordinated control mode.

Figure 9:
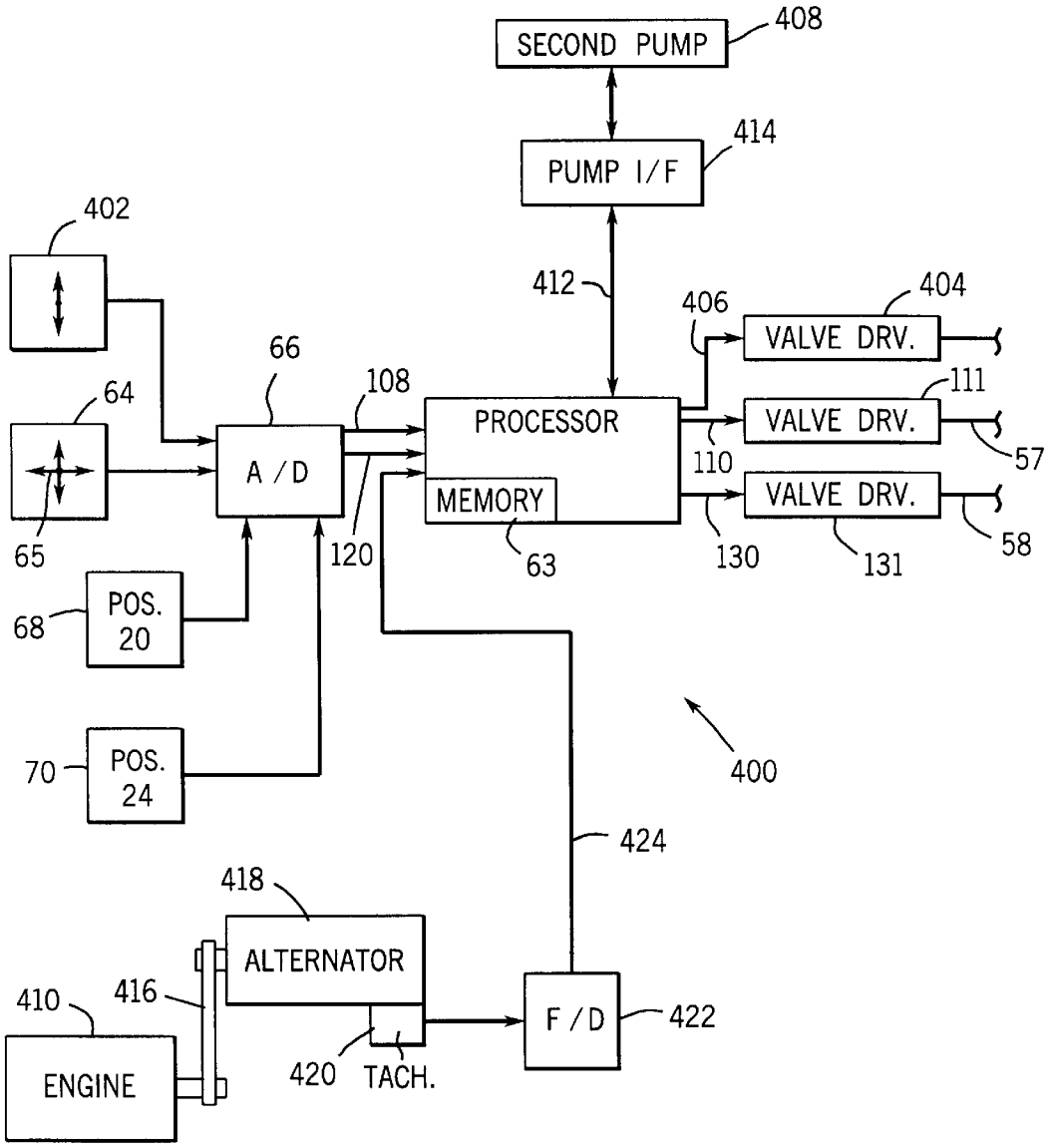
FIG. 9 is a schematic block diagram showing the components and circuits used to determine the available amount of hydraulic fluid flow as a function of engine speed and the status of a second hydraulic fluid pump.

Before describing this flow-based control approach, changes to the control system are first described in relation to FIG. 9. A control system 400, similar to control system 60, has three additional sub-systems. The first additional sub-system includes components for controlling the vehicle's auxiliary hydraulic system, which can provide a hydraulic fluid flow to one or more auxiliary hydraulic attachments (not shown), such as those commonly provided for skid-steers. The amount of auxiliary fluid flow is commanded by an auxiliary joystick 402 which generates an electrical signal representing desired auxiliary flow, and is controlled by an auxiliary valve (not shown) responsive to an auxiliary valve signal generated by a valve driver circuit 404 based on an output 406 from processor 62. However, other embodiments of the invention do not include an auxiliary hydraulic system.

The second additional sub-system includes a second engine-driven hydraulic pump 408. Processor 62 provides a pump signal 412 which is applied to an interface circuit 414 to turn pump 408 on and off. Thus, processor 62 knows the status of pump 408. Alternatively, processor 62 may optionally receive a discrete signal from pump 408 indicating the on/off status of pump 408. In this two-speed loader pump system, pump 48 (FIG. 2) remains on whenever engine 410 is running. Second pump 408 is turned off by processor 62 when the loader is in a loader mode and arms 20 are below a predetermined height, indicating that the operator is about to dig into a pile of material, and is otherwise turned on to provide an additional source of hydraulic fluid. If both the first and second pumps were to run during a dig, too much of the available engine torque would be diverted to drive the pumps, such that loader 10 might be unable to push hard enough to move forward and push arms 20 and bucket 24 into the pile of material. Thus, second pump 408 is turned off such that less torque is used to supply fluid flow to the actuation system, and more engine torque is available for the digging operation.

The third additional sub-system includes components for sensing the speed of engine 410, and determining the available amount of fluid flow therefrom. This sub-system includes engine 410, a belt 416, an alternator 418, a speed sensor 420 (e.g., a tachometer), a frequency-to-digital (F/D) interface 422, and processor 62 programmed to form an available pump flow estimator circuit. Engine 410 causes alternator 418 to rotate via belt 416. Sensor 420, mounted to alternator 418, picks up signals from alternator 418 for communication to F/D interface 422, and the digitized engine speed signal 424 is read by processor 62. The alternator signal is a positive half-wave rectified or clipped sinusoid output from the alternator stator windings. The ratio between the speed of alternator 418 and engine 410 depends on the configuration of engine 410, belt 416 and alternator 418 (e.g., pulley sizes and alternator pole pairs). Processor 62 uses the known relationship between alternator frequency and engine speed to derive the engine speed, and then estimates available pump flow based upon the engine speed. Processor 62 also takes into account the on or off status of second pump 408 to estimate the total available pump flow.

Alternatively, other sensors can be used to sense engine speed. For example, engine speed can be sensed directly from the engine using a speed sensor coupled to the cam shaft, crank shaft, flywheel, or other engine location.

In one embodiment, the frequency of the alternator output (Hz) is related to the engine speed (rpm) by the following equation:

$$\text{Freq (Hz)}=(\text{Engine Rev/Min})*(1\ \text{Min}/60\ \text{Sec})*Ke(\text{Pulses/Rev}) \quad (1)$$

wherein Ke is the pole pair and nominal pulley ratio scalar, where six pole pairs are typical, although some alternators have eight pole pairs. The Ke value is given by:

$$Ke=6\ \text{Alternator Pulses/Rev}*(De/Da) \quad (2)$$

wherein De and Da are the engine and alternator pulley diameters, respectively, and $$\text{Engine RPM}=10(Da/De)*\text{Frequency} \quad (3)$$

Raw available pump flow is determined using the engine speed as an index to a lookup table, with the on/off status of second pump 408 also used as a lookup table parameter. Linear interpolation is used during by the table lookup routine. The raw available pump flow is preferably filtered using, for example, a first order filter to obtain a filtered available pump flow output value for later use. The values stored in the lookup table preferably account for efficiency of the pump.

Figure 7B:
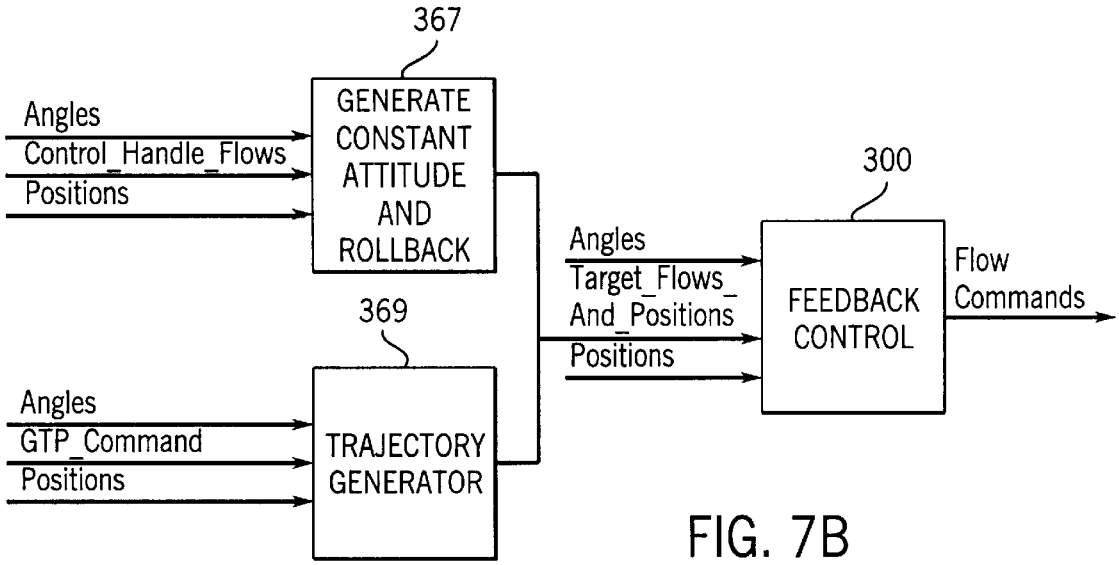
FIG. 7B is a block diagram representing the relationship between the generate feedback circuit shown in FIG. 7A and other circuits shown herein.

Referring to FIG. 7A, control circuit 300 provides four modes of operation: independent loader arm control; independent bucket control; coordinated control; and uncoordinated arm and bucket control. For increased commonality, each of the control modes use a common set of feedback loops, with differing inputs. The relationship between the generate feedback process of FIG. 7A and other processes is shown in FIG. 7B. In constant attitude mode, a generate constant attitude and rollback process 367 generates target flows and positions using angles, control handle flows, and positions. For go-to-position movements, a trajectory generator 369 generates the target flows and position signals using the angles, a go-to-position command, and the positions. The go-to-position mode need not be included in this system.

Referring back to FIG. 7A, a separate position and flow control loop is used for each axis (i.e., the arm and bucket axes). Control circuit 300 includes a control bucket position circuit 350, a control arm position circuit 352, a limit flows circuit 354, a control bucket flow circuit 356, and a control arm flow circuit 358.

Control bucket position circuit 350 receives a target bucket flow signal 315, a target bucket position signal 316 and a bucket position feedback signal 317, and generates a desired bucket flow signal 321 therefrom. Similarly, control arm position circuit 352 receives a target arm flow signal 318, a target arm position signal 319 and an arm position feedback signal 320, and generates a desired arm flow signal 322 therefrom. Alternatively, the control system could control based upon angle rather than position. Limit flows circuit 354 receives the desired bucket flow signal 321, and also receives a joystick arm flow signal 360, a joystick bucket flow signal 362, a joystick auxiliary flow signal 364, an available pump flow signal 363, and a coordinated motion signal 359. From these inputs, circuit 354 generates a limited bucket flow signal 366, a limited arm flow signal 368 and a limited auxiliary flow signal 365. Control bucket flow circuit 356 receives desired bucket flow signal 321 or limited bucket flow signal 366, and a bucket flow feedback signal 325, and generates a bucket flow command 323 therefrom. Similarly, control arm flow circuit 358 receives desired arm flow signal 322 or limited arm flow signal 368 and an arm flow feedback signal 326, and generates an arm flow command signal 324 therefrom. Limit flows circuit 354 is described below in relation to FIG. 8, control bucket position circuit 350 and control arm position circuit 352 are described below in relation to FIG. 10, and control bucket flow circuit 356 and control arm flow circuit 358 are described below in relation to FIG. 11.

During uncoordinated motion, the flow commands are determined directly from the joystick signals (i.e., joystick arm flow signal 360, joystick bucket flow signal 362, joystick auxiliary flow signal 364), and are limited by limit flows circuit 354 based on the available fluid flow to generate limited bucket flow signal 366, limited auxiliary flow signal 365, and limited arm flow signal 368. The actual AXIS flows (i.e., bucket flow signal 325 and arm flow signal 326) are used to close the loops using control bucket flow circuit 356 and control arm flow circuit 358.

For coordinated motion, a target bucket position (i.e., target bucket position signal 316) and target bucket flow (i.e., target bucket flow signal 315) are generated to maintain constant bucket attitude with respect to frame 12. A position control loop is closed around these targets to generate a desired bucket flow. The desired bucket flow is used to calculate the flow command, but the command for the bucket is not scaled down since this would interfere with maintaining coordination. The flow commands determined from the joystick signals for the auxiliary system and the arm (i.e., joystick arm flow signal 360 and joystick auxiliary flow signal 364) are limited by limit flows circuit 354, and the flow loops are then closed in the same manner as during uncoordinated motion.

To keep the bucket attitude constant, the sum of the arm angle and the bucket angle is calculated to determine a coordination angle. As stated above, target bucket position signal 316 and target bucket flow signal 315 are generated to maintain constant attitude. Constant attitude is enabled if the bucket control handle is in neutral and the arm control handle is not, and a constant attitude switch is on. Constant attitude is also enabled if coordination angle exceeds a maximum rollback angle and bucket control handle flow plus a rollback offset flow exceeds the target bucket flow. The offset on the bucket flow insures that the bucket is commanded more than enough to maintain coordination. The maximum rollback angle is set to a value greater than the maximum acceptable bucket attitude to insure that constant attitude will be enabled automatically to prevent having material dumped from the bucket onto the vehicle when the loader arms are raised. The above logic for enabling constant attitude can be described using the following pseudo-code:

```
If (Bucket_Control_Handle=Neutral and Arm_Control_Handle!=Neutral and Constant_Attitude_SW) or (Coord_Angle>Max Rollback_Angle and (Bucket_Control_Handle_Flow+Rollback_Offset_Flow)>Target_Bucket_Flow)=TRUE then
    ENABLE Constant_Attitude
endif
```

Constant attitude is disabled in several situations. Constant attitude is disabled a short time (Coord_Exit_Delay) after both control handles are in neutral or immediately if the bucket control handle leaves neutral. Constant attitude is also disabled if the operator is driving the arm up against the upper stop or down against the lower stop (to eliminate any bucket movement due to sensor noise), and is then re-enabled when the arms move out of these areas. Constant attitude is also disabled if the bucket flow is close to zero and the bucket position is near the stop when flow is commanded toward the stop. The arm will continue to be commanded normally, but the bucket will not be commanded, until the bucket control handle returns to neutral and leaves again. This will prevent the bucket from being forced against the stop, which would cause the pressure to increase and engine speed to decrease, thereby slowing the system. The following pseudo-code describes this logic:

```
If (Constant_Attitude=Enabled and Bucket_Control_Handle=Neutral and Arm_Control_Handle=Neutral)
    INCREMENT Coord_Exit_Timer
endif
If (Coord_Exit_Timer>Coord_Exit_Delay)
    DISABLE Constant_Attitude
    RESET Coord_Exit_Timer
endif
```

```
If (Arm_Control_Handle_Flow>0 and Arm_Angle>Max_CA_Arm Angle) or (Arm_Control_Handle_Flow<0 and Arm_Angle<Min_CA_Arm_Angle) then
    DISABLE Constant_Attitude
endif
If ((Bucket_Flow<Bucket_Stop_Flow and Bucket_Position>Bucket_Upper_Coord_Stop and Arm_Control_Handle_Flow<0) or (Bucket_Flow>Bucket_Stop_Flow and Bucket_Position<Bucket_Lower_Coord_Stop and Arm_Control_Handle_Flow>0) then
    DISABLE Constant_Attitude
endif
```

wherein Max_CA_Arm_Angle is set just below the top mechanical stop and Min_CA_Arm_Angle is set just above the bottom mechanical stop.

The coordinated angle setpoint is the coordination angle the control attempts to maintain when constant attitude is enabled. The setpoint is set to the current coordination angle each time the bucket control handle is returned to neutral or a go-to-position operation is completed. The logic to determine the coordinated angle setpoint preferably includes a "cumulative bucket error reset feature". This logic first determines whether the absolute value of coordinated error (Coord_Angle−Coord_Angle_Setpoint) exceeds a threshold (Max_Coord_Error) when coordinated control is initiated. If so, the setpoint is reset to the current coordination angle plus an allowed error (Max_Coord_Error) in the proper direction. This prevents the bucket from excessive jerking when coordinated motion is initiated, even if the bucket moved or leaked down when the joystick was in neutral.

```
If (abs(Coord_Angle−Coord_Angle_Setpoint)>Max_Coord_Error) then
    Coord_Angle_Setpoint=Coord_Angle+Max_Coord_Error*SGN(Coord_Angle−Coord_Angle_Setpoint)
else
    Coord_Angle_Setpoint=Arm_Angle+Bucket_Angle
endif
```

The target bucket position is calculated as a function of the difference between the coordination angle setpoint and arm angle. This function is dependent on the machine kinematics (i.e., relationship between the angle and machine) and is implemented using a lookup table for converting angular value to a position value. Other implementations are also possible. When constant attitude is enabled,

```
Target_Bucket_Position=TableLookUp(Coord_Angle_Setpoint−Arm_Angle, Bucket_Angle_Pts, Bucket_Position_Pts)
```

The target bucket flow is generated from the arm control handle flow from the previous loop. The arm flow is then converted to arm cylinder velocity, using the area of the piston, and the arm cylinder velocity is then converted to arm angular velocity using the slope of position vs. angle curves. The error due to the fact that the slope changes as the angle changes is corrected by the position feedback loop. To maintain constant attitude, the angular velocity of the bucket should be equal in magnitude, but with an opposite sign, from the angular velocity of the arm. The angular bucket velocity can then be converted back into flow in a similar manner. Alternatively, target bucket flow can be estimated from the handle flow in different ways. These conversions are described in pseudo-code as follows:

```
If (Arm_Control_Handle_Flow>0) then
    Target_Bucket_Flow=Arm_To_Bucket_Flow_Pos_Const*Arm_Control_Handle_Flow
else
    Target_Bucket_Flow=Arm_To_Bucket_Flow_Neg_Const*Arm_Control_Handle_Flow
endif
```

For go-to-position motions, the position and flow loops are used and flow is not limited using limit flows circuit 354. The flow targets are limited with a trajectory generator. The desired flows are fed directly into the flow control loops.

Figure 8:
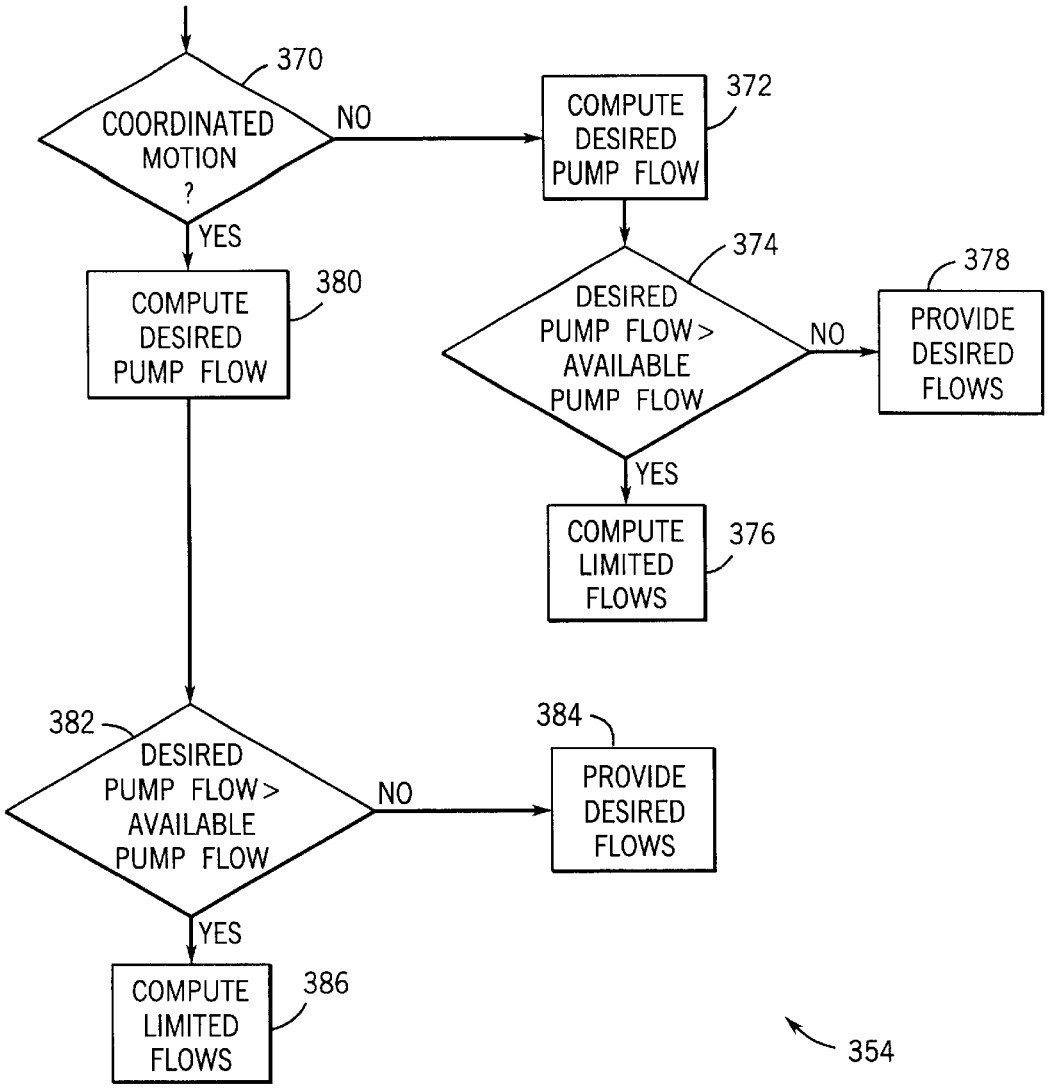
FIG. 8 is a flow chart illustrating the operation of the "limit flows" circuit shown in FIG. 7A.

Referring to FIG. 8, limit flows circuit 354 is configured to determine the available amount of hydraulic fluid flow and, when the total amount of commanded fluid flow for the bucket, arm and auxiliary systems exceeds the available fluid flow, to scale back or limit the desired bucket, arm and auxiliary flow commands such that the commanded flow will not exceed the available flow. If the available fluid flow were to be exceeded, the flow to each actuator would not be as commanded, and undesirable results would occur, such as loss of constant attitude, inadequate flow to a hydraulic actuator, uncoordinated trajectories, etc. Limit flows logic 354 results in optimal performance since all the available flow is used if needed. Faster movement can only occur if coordination is not maintained.

In coordinated motion, the desired bucket flow from the position loop is used to calculate the desired flow, but the command is not scaled down since this would interfere with maintaining coordination. In other words, during coordinated motion, the bucket is given priority over the arm. For uncoordinated motion, the joystick bucket command is used and is scaled down in the same way as the arm.

The operations performed by limit flows circuit 354 for a loader backhoe are described in reference to both FIGS. 7A and 8. Limit flows circuit 354 first checks whether control system 300 is operating in a coordinated motion mode at step 370. If not, desired pump flow is computed at step 372 by summing the absolute values of commanded flows 360, 362 and 364. The desired pump flow is then compared to available pump flow at step 374, which was determined based upon the engine speed and on/off status of pump 408. If the desired pump flow is less than available pump flow, limited bucket, arm and auxiliary flow signals 366, 368 and 365 are set to their respective desired flows (i.e., to signals 360, 362 and 364, respectively), and the limited flow signals are provided to control bucket flow circuit 356, control arm flow circuit 358 and the auxiliary valve, at step 378. If, however, the desired pump flow exceeds available pump flow, then reduced flows are computed at step 376, and are communicated to control bucket flow circuit 356, control arm flow circuit 358 and the auxiliary valve, respectively. To determine the reduced flow amount, processor 62 calculates a reduction ratio equal to available pump flow divided by desired pump flow. Limited bucket flow 366, limited arm flow 368, and limited auxiliary flow 365 are then determined by multiplying the reduction ratio by the respective desired flows (i.e., signals 360, 362 and 364).

A similar process is followed when control system 60 operates in a coordinated motion mode. At step 380, desired pump flow is again computed by summing the absolute values of commanded flows 360, 362 and 364. The desired pump flow is then compared to available pump flow at step 382. If desired pump flow is less than the available pump flow, the desired flows (i.e., signals 360, 362 and 364) are provided to control bucket flow circuit 356, control arm flow circuit 358, and the auxiliary valve, at step 384. However, if desired pump flow exceeds available pump flow, reduced flows are computed at step 386 and are communicated to control bucket flow circuit 356, arm flow circuit 358 and aux valve, respectively.

To determine the reduced flow amount during coordinated motion, processor 62 first calculates a desired flow for the auxiliary system and the arm by summing the absolute values of joystick arm flow 360 and joystick aux flow 364, and then calculates available flow for the auxiliary system and arm by subtracting desired bucket flow 321 from available pump flow. Then, processor 62 calculates a reduction ratio equal to the available flow for the auxiliary system and arm divided by the desired flow for the auxiliary system and the arm. Limited arm flow 368 and limited auxiliary flow 365 are then determined by multiplying this reduction ratio by the respective desired flows (i.e., signals 360 and 364). Limited bucket flow 366 is set to the full desired bucket flow 321 in order to maintain coordinated control.

Thus, when the total desired pump flow exceeds the available pump flow, the desired flows are scaled back or limited at steps 376 or 386 to a point such that the sum of the limited flow commands equals the available pump flow. The manner in which the desired flows are limited depends on whether the system is operating in a coordinated or an uncoordinated control mode. When operating in an uncoordinated mode, all of the joystick commands are scaled down by the same proportion. In coordinated motion, desired bucket flow 321 is not subject to being scaled down to avoid interfering with maintaining coordination, and only the flow commands for the arm and the auxiliary system are subject to being scaled down.

Figure 10:
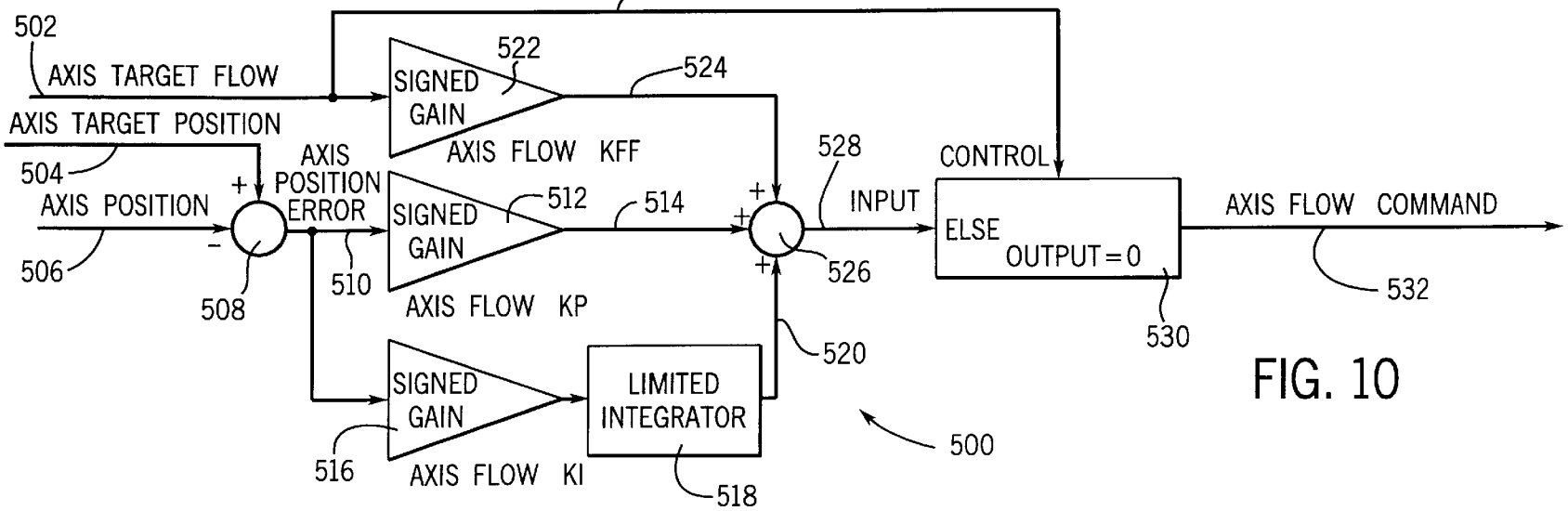
FIG. 10 is a block diagram of both the control bucket position and the control arm position circuits shown in FIG. 7A.

Referring to FIG. 10, control bucket position circuit 350 and control arm position circuit 352 (FIG. 7A) are each implemented using logic 500 (with "AXIS" replaced by "bucket" for control bucket position circuit 350, and replaced by "arm" for control arm position circuit 352). Logic 500 receives inputs including an AXIS target flow 502, an AXIS target position 504, and an AXIS position 506. AXIS target flow 502, AXIS target position 504, and AXIS position 506 correspond to target bucket flow 315, target bucket position 316, and bucket position 317, or to target arm flow 318, target arm position 319, and arm position 320, respectively.

In one embodiment of logic 500, an adder 508 subtracts AXIS position 506 from AXIS target position 504 to produce an AXIS position error 510. Error 510 is multiplied by a proportional gain 512 to produce a proportional error signal 514. Error 510 is also multiplied by an integral gain 516 and subsequently integrated by limited integrator 518 to produce an integral error signal 520. The output of integrator 518 is forced within upper and lower limits, and the integrator output is reset whenever the process is not in use (i.e., whenever constant attitude control for the bucket position, or go-to-position modes, is not active). AXIS target flow 502 is multiplied by a feed-forward gain 522 to produce a feed-forward signal 524. Feed-forward gain 522 may have a value of, e.g., 1.0 or slightly less than 1.0 (e.g., 0.9). An adder 526 sums proportional error signal 514, integral error signal 520, and feed-forward signal 524 to produce an input signal 528. A gate circuit 530 receives input signal 528 as an input, and AXIS target flow 502 as a control signal. Logic circuit 530 determines whether AXIS target flow 502 and AXIS desired flow (input signal 528) have the same sign. If so, circuit 530 sets AXIS desired flow 532 equal to input signal 528. Otherwise, AXIS desired flow 532 is set to zero. Flow 532 generically represents desired bucket flow 321 or desired arm flow 322.

The use of the feed-forward position control approach herein has several benefits. For example, the feed-forward position control path increases the control accuracy (i.e., lower error) since a lower gain value can be used for the position feedback path, while still generating an accurate flow command which meets the system's performance requirements. Another benefit is that less reliance is placed on the integral feedback path, which is subject to integrator windup.

Control AXIS position control loops 350 and 352 are used with a trajectory generator, and control bucket position circuit 350 is also used for constant attitude control. Arm position control loop 352 is only used with the trajectory generator. This control loop generates a flow command for the control AXIS flow control loops 356 and 358 which attempts to drive both a flow and a position command to zero. Control loops 350 and 352 have three terms. The first term is feed-forward signal 524 which directly commands the valve to move open based on the flow command. The second term is proportional error signal 514 which closes the loop around the position command. The third term is integral error signal 520 which is provided to further reduce the position error, such that the position error can be driven to zero. The proportional and integral gains are set to relatively small values, and in proper proportion to allow for stable operation (i.e., no oscillation). Circuit 530 insures the AXIS desired flow always has the same sign as the target flow by setting the AXIS desired flow to zero if noise causes the signs to differ.

When the joysticks are in neutral (except for the short delay set by the value Coord_Exit_Delay in the case of coordinated motion and go-to-position commands), the AXIS desired flow is set to 0 to insure that no movement occurs due to noise on the flow signal. The controller will continue to attempt to drive the bucket error to 0 for a short period of time (set by the value of Coord_Exit_Delay and measured by the timer Coord_Exit_Timer) after the joystick is returned to neutral, and will then make no valve commands until the joystick leaves neutral. This timer logic insures that the controller has enough time to reduce the bucket error after short periods of coordinated control, such as those that occur during jogging by the operator. The length of time that the bucket is allowed to move (i.e., the Coord_Exit_Delay value) after the arm movement has stopped (measured by Coord_Exit_Timer) is set to a value too short for the operator to perceive.

The above-described feature is referred to as the "coordinated exit delay" feature. When the joystick returns to neutral (e.g., when the operator lets go of the joystick), bucket movement is not generally desirable since the joystick is not being moved. However, if bucket movement were stopped immediately when the joystick returned to neutral, a small error in bucket position would exist since there was no time for the controller to move the bucket. Thus, the bucket may not be level. To solve this problem, the Coord_Exit_Timer timer allows bucket movement to occur for a short time period (which is not perceivable to the operator) to allow the controller to flatten out the bucket and reduce the error. For example, if an operator is moving forks near the ground and lets go of the joystick, the timer will provide a small amount of time for the controller to make the forks more level.

Figure 11:
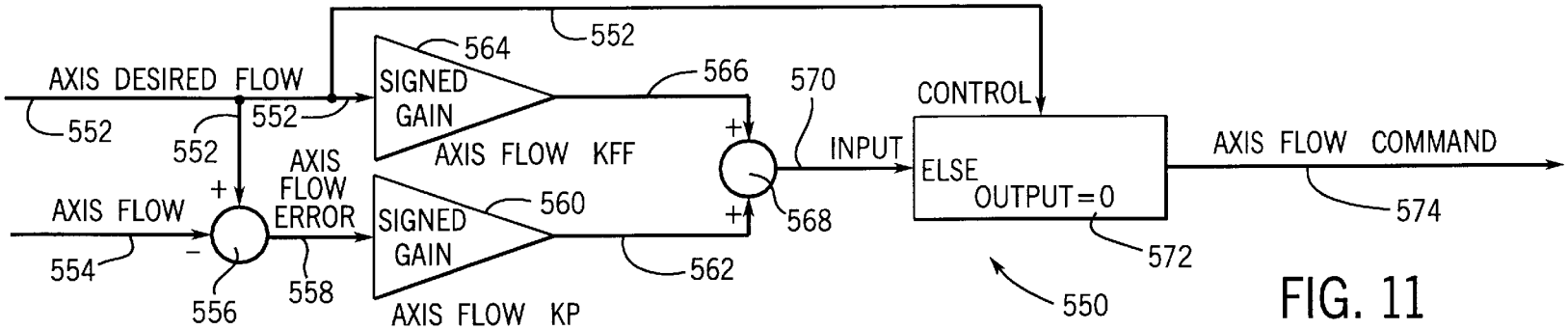
FIG. 11 is a block diagram of both the control bucket flow and the control arm flow circuits shown in FIG. 7A.

Referring to FIG. 11, control bucket flow circuit 356 and control arm flow circuit 358 (FIG. 7A) are each implemented using logic 550 (with "AXIS" replaced by "bucket" for control bucket flow circuit 356, and by "arm" for control arm flow circuit 358). Logic 550 receives inputs including an AXIS desired flow 552 and an AXIS flow 554, which correspond to limited bucket flow 366 and bucket flow 325, respectively, or to limited arm flow 368 and arm flow 326, respectively.

In one embodiment of logic 550, an adder 556 subtracts AXIS flow 554 from AXIS desired flow 552 to produce an AXIS flow error 558. Error 558 is multiplied by a proportional gain 560 to produce a proportional error signal 562. AXIS desired flow 552 is multiplied by a feed-forward gain 564 to produce a feed-forward signal 566. Feed-forward signal 566 is added to proportional error signal 562 at an adder 568 to produce an input signal 570. A gate circuit 572 receives input signal 570 as an input, and AXIS desired flow signal 552 as a control signal. Circuit 572 determines if input signal 570 and AXIS desired flow signal 552 have the same sign. If so, AXIS flow command 574 is set equal to input signal 570. Otherwise, AXIS flow command 574 is set to zero. AXIS flow command 574 generically represents bucket flow command 323 or arm flow command 324.

Thus, AXIS flow command 574 comprises a feed-forward term 566 that directly opens the AXIS valve as a function of the joystick command, and a proportional feedback term 562 that opens the valve as a function of the error between the commanded AXIS flow and desired AXIS flow. The feed-forward term reduces the error in the arm flow without increasing the proportional gain to the point where instability may occur under some operating conditions, and decreases the effects of noise on the AXIS flow. The feed-forward term is set to a value of one or less such that the feedback term can then increase or decrease the command as needed. Circuit 572 insures the flow command always has the same sign as the desired flow by setting the flow command to zero if noise causes the signs to differ.

Figure 12:
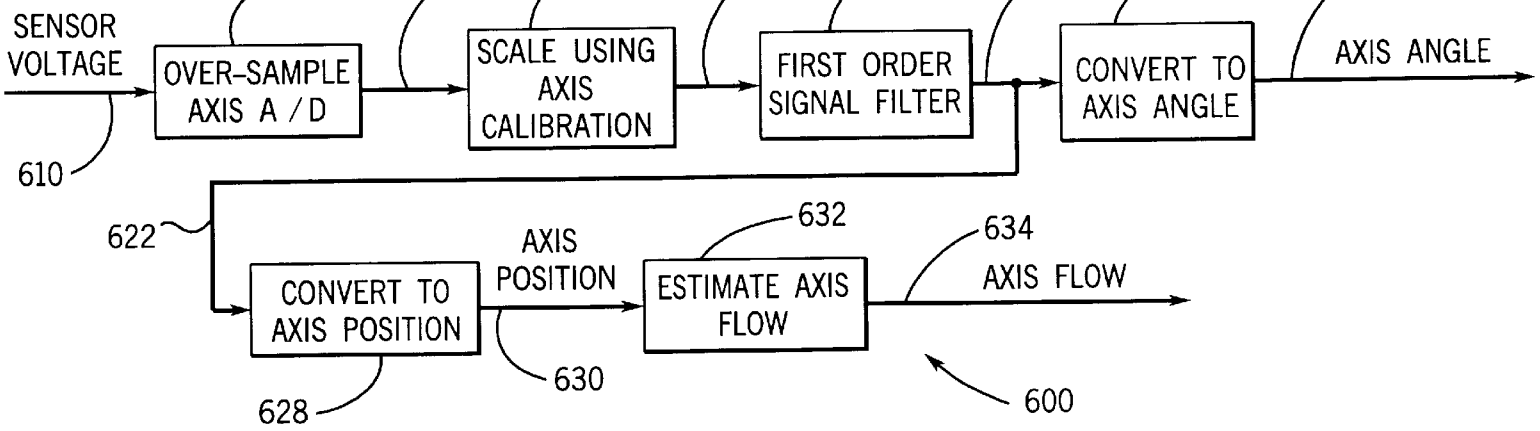
FIG. 12 is a block diagram showing circuits used to determine both the arm and bucket flows for use by the electronic control of FIG. 7A.

Referring to FIG. 12, the electrical signals received from arm position feedback sensor 68 and bucket position feedback sensor 70 are converted to engineering units and filtered by a filtering system 600, to reduce noise, before they are used as control inputs for controlling valves 56 and 58. (The logic of FIG. 12 is again repeated for the bucket and arm axes.) A sensor voltage 610 is received from either sensor 68 or 70, and is provided to an over-sampling analog-to-digital (A/D) converter 612. To reduce noise, A/D converter 612 samples sensor voltage signal 610 at a higher rate (two to four times higher) than the sampling rate of the system, stores the sampled values, and computes the average of the over-sampled signals to generate an averaged signal 614 for communication to a scaling circuit 616. Scaling circuit 616 scales averaged signal 614 using minimum and maximum calibration values, previously stored in non-volatile memory, and communicates a scaled signal 618 to a first order signal filter 620. Filter 620 is a standard low-pass first order filter. However, other filters may be used including, but not limited to, higher order filters. Filter 620 communicates a filtered signal 622 to a circuit 624 for conversion to an AXIS angle 626 (in degrees) which is preferably performed in reference to a look-up table. Filtered signal 622 is also communicated to a circuit 628 for conversion to an AXIS position. The conversion to AXIS position is also performed using a look-up table. The AXIS position is preferably defined as the cylinder displacement measured from the pin centers. Conversion circuits 624 and 628 may alternatively use conversion formulas instead of look-up tables. Once the AXIS position is known, the flow of hydraulic fluid being applied to the respective hydraulic cylinder can be estimated since the diameter of the cylinder is known. To estimate the AXIS flow, circuit 628 communicates AXIS position signal 630 to a circuit 632 for estimating the AXIS flow 634, as shown in detail in FIG. 13.

Figure 13:
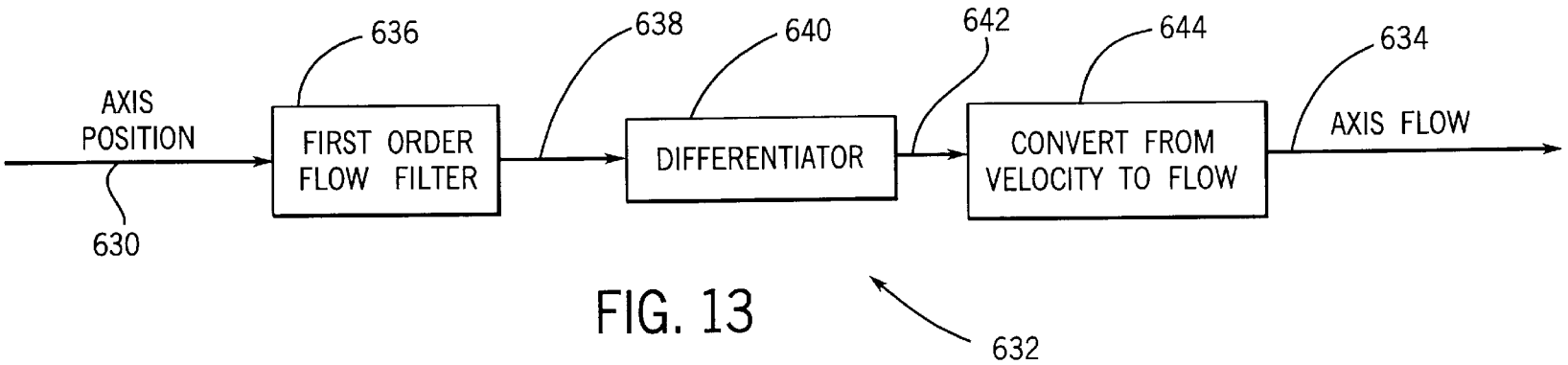
FIG. 13 is a block diagram of both the estimate arm flow and the estimate bucket flow circuits shown in FIG. 12.

Referring to FIG. 13, circuit 632 estimates AXIS flow 634 given AXIS position 630. First, AXIS position 630 is input to a first-order flow filter 636 (e.g., a standard low-pass first order flow filter). However, other filters including higher-order filters may be used. Filter 636 sends a filtered AXIS position signal 638 to a differentiator 640, which converts signal 638 to an AXIS velocity signal 642. The AXIS velocity 642 is communicated to a circuit 644 for conversion from velocity to AXIS flow 634. The conversion from velocity to flow accounts for the area of the hydraulic actuator piston. Thus, the conversion depends on the sign of the velocity. For positive velocities, AXIS flow is a function of the actuator's area and the AXIS positive velocity (AXIS_Flow=Axis_Pos_Area*AXIS_Velocity). For negative velocities, AXIS flow is a function of the actuator's area and the AXIS negative velocity (AXIS_Flow=AXIS_Neg_Area*AXIS_Velocity). AXIS angle 626 generically represents bucket position 317 or arm position 320 (FIG. 7A). Similarly, AXIS flow 634 generically represents bucket flow 325 or arm flow 326.

Alternatively, AXIS flow for either or both the arm and bucket may be measured directly using flow sensors fluidly coupled to the respective hydraulic cylinders. However, depending upon the placement of the flow sensors, accuracy of the resulting flows being applied to the cylinders may be adversely affected by, for example, a leak in the hydraulic lines leading to the cylinders. In this situation, the flow sensor may erroneously measure flow that does not actually reach the cylinder. Flow signals determined by the use of position sensors are not adversely affected by such a leak, and the flows actually applied to the cylinder are correctly determined.

When an operator commands movement using joystick 64, the joystick command represents an AXIS flow. It is preferable in some instances to represent an AXIS flow to more closely emulate a loader with non-electrohydraulic valves and also to meet expectations of an operator for the feel of the control. The flow represented by the joystick command is scaled down only if the total flow command exceeds the available pump flow, as estimated by subsystem 400. This ensures that both axes will move when commanded, such that flow to one axis will not starve the other of hydraulic fluid flow.

Figure 14:
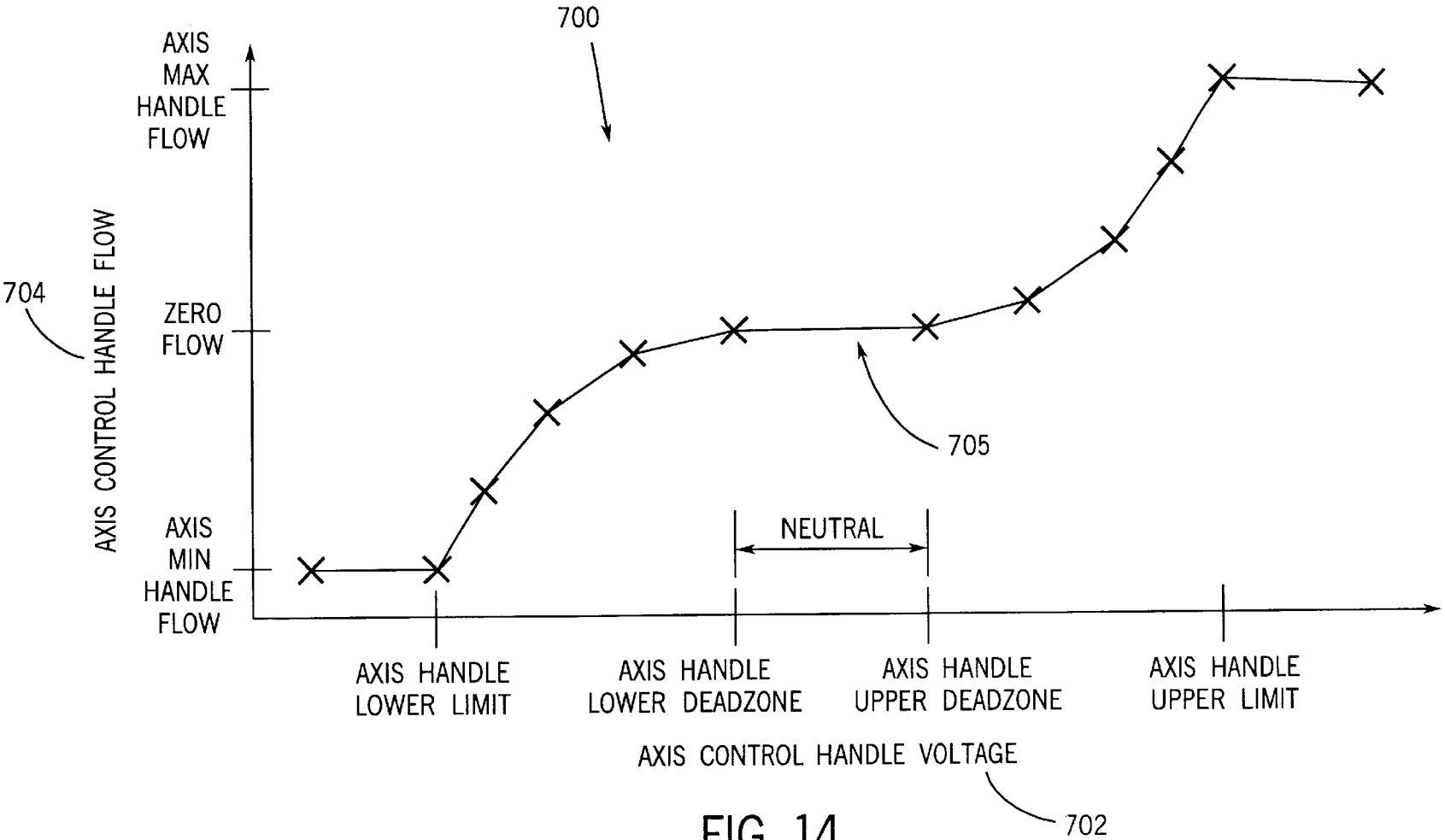
FIG. 14 is a graph showing the relationship between the voltages generated by the joystick of FIG. 3 and the arm and bucket flow commands.

As depicted in FIG. 14, the relationship between joystick travel and the flow command is non-linear to emulate a loader with non-electrohydraulic valves, as shown by the graphed relationship 700 between AXIS control handle voltage 702 and AXIS control handle flow 704. A lookup table is preferably used to implement the non-linear relationship. This non-linearity allows the joystick to be more sensitive around the center point of the joystick, thereby improving the operator's ability to finely position the loader arm and bucket. Further, a dead zone 705 included in the center of the joystick travel takes into account any mechanical tolerances on the spring return of the joystick. Thus, despite tolerances, the spring return will return the joystick mechanism to a point within the dead zone region when an operator takes his hands off the joystick.

The joystick can also include a neutral switch which is considered when calculating the flow command. There is one neutral switch for the joystick, which generates a true signal when the joystick is positioned in the neutral range, and is otherwise set to false. The flow command is set to zero when the neutral switch is true, and the lookup table output is used when the neutral switch is false.

The fluid flow command represented by the joystick command is scaled down or limited, as described above, only if the total commanded fluid flow exceeds the estimated available pump flow. Thus, both the arm and bucket move when they are commanded, and flow to neither cylinder will starve the other.

In one embodiment, all of the valves for loader 10 are controlled from flow commands as described above. The flow commands are converted to valve voltage commands suitable for use with Danfoss PVG32 valves, with spool type E used for all sections. In another embodiment, other electrohydraulic valves may be applied in a similar manner. Flow commands 323 and 324, as depicted in FIG. 7A, are converted to valve commands based on flow characteristics for the electrohydraulic valves being used. In one embodiment, each hydraulic valve has two pressure regulating pilot stages, with one stage driving the main spool in one direction and the second stage driving the main spool in the other direction. Each pressure regulating pilot may be a Thomas Magnete proportional pressure reducing valve (PPRV), but other types of hydraulic valves may also be used. A different number of electrical actuators can control the valve, with the Thomas Magnete valve having two coils and the Danfoss valve having four. The Danfoss valve includes a position sensor coupled to the main spool, and built-in electronics which interpret a voltage command as flow and provide closed-loop control over the spool position.

The control depicted in FIG. 7A and described therewith may be used to keep the bucket attitude constant. To keep the bucket attitude constant, the sum of the arm 20 and bucket 24 angles is calculated to provide a coordination angle, as described in further detail above. This process generates target bucket position 316 and target bucket flow 315 to maintain constant attitude. If the bucket control handle is in a neutral position and the arm control handle is not, and the constant attitude switch is on, then constant attitude is enabled. Constant attitude is also enabled automatically to keep the bucket from rolling too far when the arms are raised. The control described above may also be applied to go-to-position controls, return-to-dig controls, and may include anti-gouging and anti-rollback features.

A loader such as loader 10 may have, in an alternative embodiment, a bucket having a clam, wherein the clam bucket has an auxiliary axis controlled by an operator. The clam bucket can be used, for example, to open the bucket for dumping dirt out of the bucket, or to grab objects, such as logs. An auxiliary axis, such as for a clam bucket, may be controlled by a thumb-wheel on a joystick, the thumb-wheel signal being communicated to limit flows subsystem 354 along a communication line 364. Limit flow subsystem 354 uses the requested auxiliary flow in computing the limited flows 366, 368, and a limited auxiliary flow 365.

The control described above may be applied to a variety of work vehicles including, but not limited to, loaders, backhoes, loader/backhoes, skid-steers, and the like. Further, the operator controls are not limited to a single joystick but may also include buttons, thumb-wheels, and multiple joysticks.

While the detailed drawings, specific examples, and particular component values given describe preferred embodiments of the present invention, they serve the purpose of illustration only. For example, the control circuits and logic of system 60 and any of the other systems and subsystems for the work vehicle are implemented with a programmed digital processor. However, the circuits and logic could also be implemented with analog circuitry. Furthermore, the PWM valve signals could be replaced with analog signals depending upon the valve drivers and valve solenoids used for a particular application. The apparatus of the invention is not limited to the precise details and conditions disclosed. Furthermore, other substitutions, modifications, changes, and omissions may be made in the design, operating conditions, and arrangement of the preferred embodiments without departing from the spirit of the invention as expressed in the appended claims.

What is claimed is:

1. A control for an implement including at least one arm pivotally supported by a vehicle having a frame and an attachment pivotally attached to the arm, wherein the arm is pivoted relative to the vehicle by a first hydraulic actuator and the attachment is pivoted relative to the arm by a second hydraulic actuator, the vehicle including an engine and a hydraulic fluid supply powered by the engine, the control comprising:

a first sensor for generating a first sensed signal representative of the actual fluid flow being applied to the first hydraulic actuator;

a second sensor for generating a second sensed signal representative of the actual fluid flow being applied to the second hydraulic actuator;

an input device including an operator interface assembly moveable by an operator relative to first and second axes, and first and second signal generators for generating first and second control signals representative of motion of the interface assembly about the first and second axis, respectively;

a hydraulic valve assembly coupled to the hydraulic fluid supply and responsive to first and second valve signals to control hydraulic fluid flow to the first and second hydraulic actuators, respectively;

a digital control circuit coupled to the sensors, the input device, and the valve assembly, the control circuit configured to determine the first and second actual fluid flows applied to the first and second hydraulic actuators based upon the first and second sensed signals, respectively, and to determine first and second desired fluid flows based upon the first and second control signals, respectively, the control circuit further being configured to generate the first valve signal as a function of the first actual fluid flow and the first desired fluid flow, to generate the second valve signal as a function of the second actual fluid flow and the second desired fluid flow, and to apply the first and second valve signals to the valve assembly to pivot the arm and to pivot the attachment; and the first and second sensors including first and second position sensors for generating first and second position signals representative of the position of the arm relative to the vehicle and the position of the attachment relative to the arm, respectively, and the control circuit configured to estimate the first and second actual fluid flows based upon the positions of the arm and of the attachment respectively.

2. The control of claim 1, wherein the control circuit is further configured to operate in a coordinated control mode, wherein the second valve signal is generated independently of the second control signal when the interface assembly is only moved about the first axis such that the second hydraulic actuator pivots the attachment to maintain a predetermined relationship between the attachment and the frame while the arm is pivoted by the first hydraulic actuator in response to the first control signal.

3. The control of claim 1 wherein the input device includes a two-axis joystick, and the operator interface assembly includes a lever.

4. The control of claim 1, further comprising a speed sensor coupled to the engine for generating an engine speed signal, wherein the control circuit is coupled to the speed sensor and is further configured to determine available hydraulic fluid flow based at least upon the engine speed signal, to sum the first and second desired fluid flows, to compare the sum to the available hydraulic fluid flow, and to limit the desired fluid flows when the sum exceeds the available hydraulic fluid flow.

5. The control of claim 4 wherein the vehicle also includes an alternator coupled to the engine, and the speed sensor includes a tachometer coupled to the alternator.

6. The control of claim 4 wherein the hydraulic fluid supply includes first and second engine-driven pumps, second pump being coupled to the control circuit and controllable between an on state and an off state, wherein the determination of available hydraulic fluid flow by the control circuit is also based on the state of the second pump.

7. The control of claim 6 wherein the control circuit is configured to turn on and off the second pump in response to the position of the arm relative to the vehicle.

8. The control of claim 1, wherein the vehicle also includes an auxiliary hydraulic system for providing an auxiliary fluid flow, the control further comprising an auxiliary input device and an auxiliary valve assembly, the auxiliary input device including an operator interface assembly and a signal generator for generating a desired auxiliary flow signal representative of motion of the interface assembly, the auxiliary valve assembly coupled to the hydraulic fluid supply and responsive to an auxiliary valve signal to control the auxiliary fluid flow, wherein the control circuit is also configured to generate the auxiliary valve signal based upon the desired auxiliary flow signal.

9. The control of claim 8 also comprising a speed sensor coupled to the engine for generating an engine speed signal, wherein the control circuit is coupled to the speed sensor and is further configured to determine available hydraulic fluid flow based at least upon the engine speed signal, to sum the first and second desired fluid flows and the desired auxiliary flow, to compare the sum to the available hydraulic fluid flow, and to limit the desired fluid flows when the sum exceeds the available hydraulic fluid flow.

10. The control of claim 1 wherein the attachment includes a first component and a second component pivoted relative to the first component by a third hydraulic actuator, the valve assembly responsive to a third valve signal to control fluid flow to the third actuator, the input device including a second moveable operator interface assembly and a third signal generator for generating a third control signal representative of motion of the second interface assembly, and the control circuit applies the third valve signal to the valve assembly based upon the third control signal.

11. The control of claim 10 wherein the second interface assembly includes a thumb-wheel rotatable about a third axis for generating the third control signal.

12. The control of claim 1 wherein the control circuit is operable in a coordinated mode wherein the first and second valve signals maintain a predetermined relationship between the attachment and the frame while the arm is pivoted by the first actuator.

13. The control of claim 12 wherein the attachment is a bucket, and the hydraulic actuators are hydraulic cylinders.

14. The control of claim 13 wherein, during a transition from the coordinated mode to a neutral mode, the control circuit continues to provide control over the bucket for a predetermined time period to reduce the error between the predetermined and the actual relationships between the attachment and the frame.

15. The control of claim 13 wherein the coordinated mode has a coordinated angle setpoint and wherein, upon initiation of the coordinated mode, the coordinated angle setpoint is reset to a coordinated angle plus an allowed error value if the coordinated angle differs from the previous coordinated angle setpoint by more than a certain value.

16. The control of claim 1, wherein the determination of the first and second desired fluid flows includes a position-based control having a feedforward term.

17. The control of claim 16, wherein the determination of the first and second desired fluid flows also includes a proportional term.

18. The control of claim 17, wherein the determination of the first and second desired fluid flows also includes an integral term.

19. The control of claim 1 wherein the control is applied to a vehicle selected from the group consisting of backhoes, loaders, loader/backhoes, and skid steers.

20. A control for an implement including at least one arm pivotally supported by a vehicle having a frame and an attachment pivotally attached to the arm, wherein the arm is pivoted relative to the vehicle by a first hydraulic actuator and the attachment is pivoted relative to the arm by a second hydraulic actuator, the vehicle including an engine and a hydraulic fluid supply powered by the engine, the control comprising:

a first sensor for generating a first sensed signal responsive to motion of the arm relative to the vehicle and representative of the actual fluid flow being applied to the first hydraulic actuator;

a second sensor for generating a second sensed signal responsive to motion of the attachment relative to the arm and representative of the actual fluid flow being applied to the second hydraulic actuator;

a speed sensor coupled to the engine for generating an engine speed signal;

an input device including an operator interface assembly moveable by an operator relative to first and second axes, and first and second signal generators for generating first and second control signals representative of motion of the interface assembly about the first and second axis, respectively;

a hydraulic valve assembly coupled to the hydraulic fluid supply and responsive to first and second valve signals to control hydraulic fluid flow to the first and second hydraulic actuators, respectively;

a digital control circuit coupled to the sensors, the input device, and the valve assembly, the control circuit configured to apply the first and second valve signals to the valve assembly such that fluid flow is applied to the first hydraulic actuator to pivot the arm so that the first sensed signal and the first control signal maintain a first predetermined relationship, and fluid flow is applied to the second hydraulic actuator to pivot the attachment such that the second sensed signal and the second control signal maintain a second predetermined relationship, the control circuit further configured to determine first and second desired fluid flows based on the first and second control signals, to determine available fluid flow based at least upon the engine speed signal, to sum the first and second desired fluid flows, to compare the sum to the available fluid flow, and to limit the desired fluid flows when the sum exceeds the available fluid flow; and the first and second sensors including first and second position sensors for generating first and second position signals representative of the position of the arm relative to the vehicle and the position of the attachment relative to the arm, respectively, and the control circuit configured to estimate the first and second actual fluid flows based upon the positions of the arm and of the attachment, respectively.

21. The control of claim 20, wherein the control circuit is further configured to operate in a coordinated control mode, wherein the second valve signal is generated independently of the second control signal when the interface assembly is only moved about the first axis such that the second hydraulic actuator pivots the attachment to maintain a predetermined relationship between the attachment and the frame while the arm is pivoted by the first hydraulic actuator in response to the first control signal.

22. The control of claim 21 wherein the first sensor includes a first position sensor for generating a first position signal representative of the position of the arm relative to the vehicle, and the second sensor includes a second position sensor for generating a second position signal representative of the position of the attachment relative to the arm, the first and second control signals maintaining the first and second relationships between the first and second position signals and the first and second control signals, respectively, and wherein the control circuit provides a velocity-based control.

23. The control of claim 21 wherein the vehicle also includes an auxiliary hydraulic system for providing an auxiliary fluid flow, the control further comprising an auxiliary input device and an auxiliary valve assembly, the auxiliary input device including an operator interface assembly and a signal generator for generating a desired auxiliary flow signal representative of motion of the interface assembly, the auxiliary valve assembly coupled to the hydraulic fluid supply and responsive to an auxiliary valve signal to control the auxiliary fluid flow, wherein the control circuit is also configured to generate the auxiliary valve signal based upon the desired auxiliary flow signal.

24. The control of claim 20 wherein the hydraulic fluid supply includes first and second engine-driven pumps, the second pump being coupled to the control circuit and controllable between an on state and an off state, wherein the determination of available hydraulic fluid flow by the control circuit is also based on the state of the second pump.

25. The control of claim 24 wherein the control circuit is configured to turn on and off the second pump in response to the position of the arm relative to the vehicle.

26. The control of claim 20 wherein the control circuit is operable in a coordinated mode wherein the first and second valve signals maintain a predetermined relationship between the attachment and the frame while the arm is pivoted by the first actuator and, upon initiation of the coordinated mode, a coordinated angle setpoint of the coordinated mode is reset to a coordinated angle plus an allowed error value if the coordinated angle differs from the previous coordinated angle setpoint by more than a certain value.

27. The control of claim 20 wherein the control is applied to a vehicle selected from the group consisting of backhoes, loaders, loader/backhoes, and skid steers.

28. A control for an implement including at least one arm pivotally supported by a vehicle having a frame and an attachment pivotally attached to the arm, wherein the arm is pivoted relative to the vehicle by a first hydraulic actuator and the attachment is pivoted relative to the arm by a second hydraulic actuator, the vehicle including an engine and a hydraulic fluid supply powered by the engine, the control comprising:

a first sensor for generating a first sensed signal representative of the actual fluid flow being applied to the first hydraulic actuator;

a second sensor for generating a second sensed signal representative of the actual fluid flow being applied to the second hydraulic actuator;

an input device including an operator interface assembly moveable by an operator relative to first and second axes, and first and second signal generators for generating first and second control signals representative of motion of the interface assembly about the first and second axis, respectively;

a hydraulic valve assembly coupled to the hydraulic fluid supply and responsive to first and second valve signals to control hydraulic fluid flow to the first and second hydraulic actuators, respectively;

a digital control circuit coupled to the sensors, the input device, and the valve assembly, the control circuit configured to determine the first and second actual fluid flows applied to the first and second hydraulic actuators based upon the first and second sensed signals, respectively, and to determine first and second desired fluid flows based upon the first and second control signals, respectively, the control circuit further being configured to generate the first valve signal as a function of the first actual fluid flow and the first desired fluid flow, to generate the second valve signal as a function of the second actual fluid flow and the second desired fluid flow, and to apply the first and second valve signals to the valve assembly to pivot the arm and to pivot the attachment;

the control circuit further configured to operate in a coordinated control mode, wherein the second valve signal is generated independently of the second control signal when the interface assembly is only moved about the first axis such that the second hydraulic actuator pivots the attachment to maintain a predetermined relationship between the attachment and the frame while the arm is pivoted by the first hydraulic actuator in response to the first control signal;

a speed sensor coupled to the engine for generating an engine speed signal, wherein the control circuit is coupled to the speed sensor and is further configured to determine available hydraulic fluid flow based at least upon the engine speed signal, to sum the first and second desired fluid flows, to compare the sum to the available hydraulic fluid flow, and to limit the desired fluid flows when the sum exceeds the available hydraulic fluid flow; and the hydraulic fluid supply including first and second engine-driven pumps, the second pump being coupled to the control circuit and controllable between an on state and an off state, wherein the determination of available hydraulic fluid flow by the control circuit is also based on the state of the second pump.

29. The control circuit of claim 28, wherein the control circuit is configured to turn on and off the second pump in response to the position of the arm relative to the vehicle.

30. A control for an implement including at least one arm pivotally supported by a vehicle having a frame and a bucket pivotally attached to the arm, wherein the arm is pivoted relative to the vehicle by a first hydraulic cylinder and the bucket is pivoted relative to the arm by a second hydraulic cylinder, the vehicle including an engine and a hydraulic fluid supply powered by the engine, the control comprising:

a first sensor for generating a first sensed signal representative of the actual fluid flow being applied to the first hydraulic cylinder;

a second sensor for generating a second sensed signal representative of the actual fluid flow being applied to the second hydraulic cylinder;

an input device including an operator interface assembly moveable by an operator relative to first and second axes, and first and second signal generators for generating first and second control signals representative of motion of the interface assembly about the first and second axis, respectively;

a hydraulic valve assembly coupled to the hydraulic fluid supply and responsive to first and second valve signals to control hydraulic fluid flow to the first and second hydraulic cylinders, respectively;

a digital control circuit coupled to the sensors, the input device, and the valve assembly, the control circuit configured to determine the first and second actual fluid flows applied to the first and second hydraulic cylinders based upon the first and second sensed signals, respectively, and to determine first and second desired fluid flows based upon the first and second control signals, respectively, the control circuit further being configured to generate the first valve signal as a function of the first actual fluid flow and the first desired fluid flow, to generate the second valve signal as a function of the second actual fluid flow and the second desired fluid flow, and to apply the first and second valve signals to the valve assembly to pivot the arm and to pivot the bucket;

the control circuit being operable in a coordinated mode wherein the first and second valve signals maintain a predetermined relationship between the bucket and the frame while the arm is pivoted by the first cylinder; and the control circuit configured to continue to provide control over the bucket for a predetermined time period to reduce the error between the predetermined and the actual relationships between the bucket and the frame, during a transition from the coordinated mode to a neutral mode.

31. The control of claim 30 wherein the coordinated mode has a coordinated angle setpoint and wherein, upon initiation of the coordinated mode, the coordinated angle setpoint is reset to a coordinated angle plus an allowed error value if the coordinated angle differs from the previous coordinated angle setpoint by more than a certain value.

32. A control for an implement including at least one arm pivotally supported by a vehicle having a frame and an attachment pivotally attached to the arm, wherein the arm is pivoted relative to the vehicle by a first hydraulic actuator and the attachment is pivoted relative to the arm by a second hydraulic actuator, the vehicle including an engine and a hydraulic fluid supply powered by the engine, the control comprising:

a first sensor for generating a first sensed signal responsive to motion of the arm relative to the vehicle;

a second sensor for generating a second sensed signal responsive to motion of the attachment relative to the arm;

a speed sensor coupled to the engine for generating an engine speed signal;

an input device including an operator interface assembly moveable by an operator relative to first and second axes, and first and second signal generators for generating first and second control signals representative of motion of the interface assembly about the first and second axis, respectively;

a hydraulic valve assembly coupled to the hydraulic fluid supply and responsive to first and second valve signals to control hydraulic fluid flow to the first and second hydraulic actuators, respectively;

a digital control circuit coupled to the sensors, the input device, and the valve assembly, the control circuit configured to apply the first and second valve signals to the valve assembly such that fluid flow is applied to the first hydraulic actuator to pivot the arm so that the first sensed signal and the first control signal maintain a first predetermined relationship, and fluid flow is applied to the second hydraulic actuator to pivot the attachment such that the second sensed signal and the second control signal maintain a second predetermined relationship, the control circuit further configured to determine first and second desired fluid flows based on the first and second control signals, to determine available fluid flow based at least upon the engine speed signal, to sum the first and second desired fluid flows, to compare the sum to the available fluid flow, and to limit the desired fluid flows when the sum exceeds the available fluid flow; and the hydraulic fluid supply including first and second engine-driven pumps, the second pump being coupled to the control circuit and controllable between an on state and an off state, wherein the determination of available hydraulic fluid flow by the control circuit is also based on the state of the second pump.

33. The control of claim 32 wherein the control circuit is configured to turn on and off the second pump in response to the position of the arm relative to the vehicle.

34. A control for an implement including at least one arm pivotally supported by a vehicle having a frame and an attachment pivotally attached to the arm, wherein the arm is pivoted relative to the vehicle by a first hydraulic actuator and the attachment is pivoted relative to the arm by a second hydraulic actuator, the vehicle including an engine and a hydraulic fluid supply powered by the engine, the control comprising:

a first sensor for generating a first sensed signal responsive to motion of the arm relative to the vehicle;

a second sensor for generating a second sensed signal responsive to motion of the attachment relative to the arm;

a speed sensor coupled to the engine for generating an engine speed signal;

an input device including an operator interface assembly moveable by an operator relative to first and second axes, and first and second signal generators for generating first and second control signals representative of motion of the interface assembly about the first and second axis, respectively;

a hydraulic valve assembly coupled to the hydraulic fluid supply and responsive to first and second valve signals to control hydraulic fluid flow to the first and second hydraulic actuators, respectively;

a digital control circuit coupled to the sensors, the input device, and the valve assembly, the control circuit configured to apply the first and second valve signals to the valve assembly such that fluid flow is applied to the first hydraulic actuator to pivot the arm so that the first sensed signal and the first control signal maintain a first predetermined relationship, and fluid flow is applied to the second hydraulic actuator to pivot the attachment such that the second sensed signal and the second control signal maintain a second predetermined relationship, the control circuit further configured to determine first and second desired fluid flows based on the first and second control signals, to determine available fluid flow based at least upon the engine speed signal, to sum the first and second desired fluid flows, to compare the sum to the available fluid flow, and to limit the desired fluid flows when the sum exceeds the available fluid flow; and the control circuit being operable in a coordinated mode wherein the first and second valve signals maintain a predetermined relationship between the attachment and the frame while the arm is pivoted by the first actuator and, during a transition from the coordinated mode to a neutral mode, continues to provide control over the attachment for a predetermined time period to reduce the error between the predetermined and the actual relationships between the attachment and the frame.

35. A control for an implement including at least one arm pivotally supported by a vehicle having a frame and an attachment pivotally attached to the arm, wherein the arm is pivoted relative to the vehicle by a first hydraulic actuator and the attachment is pivoted relative to the arm by a second hydraulic actuator, the vehicle including an engine and a hydraulic fluid supply powered by the engine, the control comprising:

a first sensor for generating a first sensed signal responsive to motion of the arm relative to the vehicle;

a second sensor for generating a second sensed signal responsive to motion of the attachment relative to the arm;

a speed sensor coupled to the engine for generating an engine speed signal;

an input device including an operator interface assembly moveable by an operator relative to first and second axes, and first and second signal generators for generating first and second control signals representative of motion of the interface assembly about the first and second axis, respectively;

a hydraulic valve assembly coupled to the hydraulic fluid supply and responsive to first and second valve signals to control hydraulic fluid flow to the first and second hydraulic actuators, respectively;

a digital control circuit coupled to the sensors, the input device, and the valve assembly, the control circuit configured to apply the first and second valve signals to the valve assembly such that fluid flow is applied to the first hydraulic actuator to pivot the arm so that the first sensed signal and the first control signal maintain a first predetermined relationship, and fluid flow is applied to the second hydraulic actuator to pivot the attachment such that the second sensed signal and the second control signal maintain a second predetermined relationship, the control circuit further configured to determine first and second desired fluid flows based on the first and second control signals, to determine available fluid flow based at least upon the engine speed signal, to sum the first and second desired fluid flows, to compare the sum to the available fluid flow, and to limit the desired fluid flows when the sum exceeds the available fluid flow; and the control circuit being operable in a coordinated mode wherein the first and second valve signals maintain a predetermined relationship between the attachment and the frame while the arm is pivoted by the first actuator and, upon initiation of the coordinated mode, a coordinated angle setpoint of the coordinated mode is reset to a coordinated angle plus an allowed error value if the coordinated angle differs from the previous coordinated angle setpoint by more than a certain value.

* * * * *